US005463552A

United States Patent [19]

Wilson, Jr. et al.

[11] Patent Number: 5,463,552

[45] Date of Patent: Oct. 31, 1995

[54] RULES-BASED INTERLOCKING ENGINE USING VIRTUAL GATES

[75] Inventors: Richard A. Wilson, Jr.; John M. Daubner; Frank D. Jeffers, all of Pittsburgh, Pa.

[73] Assignee: AEG Transportation Systems, Inc., Pittsburgh, Pa.

[21] Appl. No.: 921,756

[22] Filed: Jul. 30, 1992

[51] Int. Cl.[6] ..... G06F 163/00; B61L 27/00

[52] U.S. Cl. ..... 364/436; 246/131; 395/600; 395/902

[58] Field of Search ..... 346/436, 424.01; 246/131, 132, 133, 134; 395/920, 902, 600, 905

[56] References Cited

U.S. PATENT DOCUMENTS

| | | | |
|---|---|---|---|
| 3,976,272 | 8/1976 | Murray et al. | 364/436 X |
| 4,015,807 | 4/1977 | Bourree et al. | 246/5 |
| 4,023,753 | 5/1977 | Dobler | 364/436 X |
| 4,066,228 | 1/1978 | Elder | 246/134 X |
| 4,122,523 | 10/1978 | Morse et al. | 364/436 |
| 4,305,556 | 12/1981 | Norton et al. | 364/436 X |
| 4,467,430 | 8/1984 | Even et al. | 364/436 |
| 4,561,057 | 12/1985 | Haley, Jr. et al. | 364/436 |
| 4,641,243 | 2/1987 | Hartkopf et al. | 364/436 |
| 5,168,451 | 12/1992 | Bolger | 364/436 |
| 5,177,684 | 1/1993 | Harker et al. | 364/436 |

OTHER PUBLICATIONS

Roberto Cremonini et al., "ADES: An Expert System for ATP Design," Sep. 1989.

Roberto Cremonini et al., "Building and Optimizing an Expert System for ATP Design," IEEE, Sep. 1989, pp. 68–75.

American Railway Signaling Principles and Practices, Chapter 20, Interlocking Circuits, Published by the Communication and Signal Section, AAR, 1941, pp. 89–93.

American Railway Signaling Principles and Practices, Chapter XIX, Electric Interlocking, Published by the Communication and Signal Section, AAR, Oct. 1930, pp. 3 and 5.

American Railway Signaling Principles and Practices, Chapter XVI, Interlocking, Published by the Communication & Signal Section, AAR, Oct. 1952, four pages.

Brandl et al., "Experience with Safety Certification—As Exemplified by Computer–Assisted Railway Signal Control Systems," Article from Signal & Draht 83 (1991), pp. 1–8.

Okumura et al., "The Development of an Electronic Interlocking System," Quarterly Reports, vol. 22, No. 4, 1981, pp. 161–167.

Hill et al., "Modelling Railway Block Signalling Systems Using Discrete–Event Simulation," School of Electrical Engineering, University of Bath, Claverton Down, Bath, UK, pp. 1–9. 1992.

Lardennois, "Vital Coded Microprocessor Applications to the O'Hare AGT System," 1988 APTA Rapid Transit Conference, Advanced Technology Update Session, Jun. 8, 1988, twelve pages.

*Primary Examiner*—Kevin J. Teska
*Assistant Examiner*—Collin W. Park
*Attorney, Agent, or Firm*—Webb Ziesenheim Bruening Logsdon Orkin & Hanson

[57] ABSTRACT

A method of implementing a computer based interlocking system for automatic train protection includes providing a data base of prestored rule sets for a plurality of guideway objects, the guideway objects being represented as one or more virtual gates of a plurality of virtual gate types, the rule sets defining conditions for a respective guideway object which must be met before entry through a virtual gate of the object is permitted. A high-level description of a guideway layout including all of the guideway objects that form interlocking zones is input and processed using the prestored rule sets to form an overall interlocking system definition by locating, retrieving and linking appropriate rule sets corresponding to the respective input guideway objects.

19 Claims, 19 Drawing Sheets

FIG. 3.1a
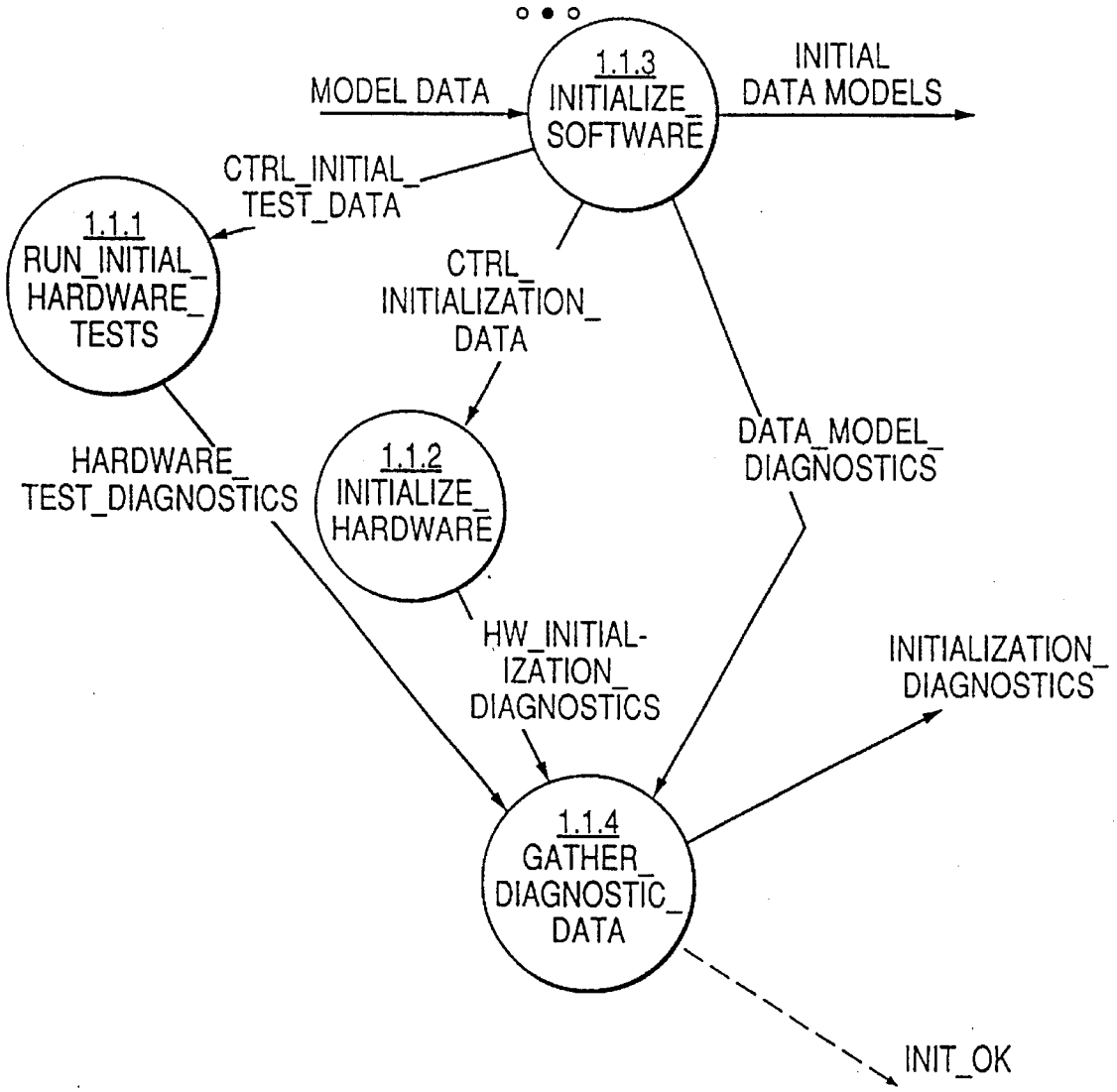

FIG. 3.1b
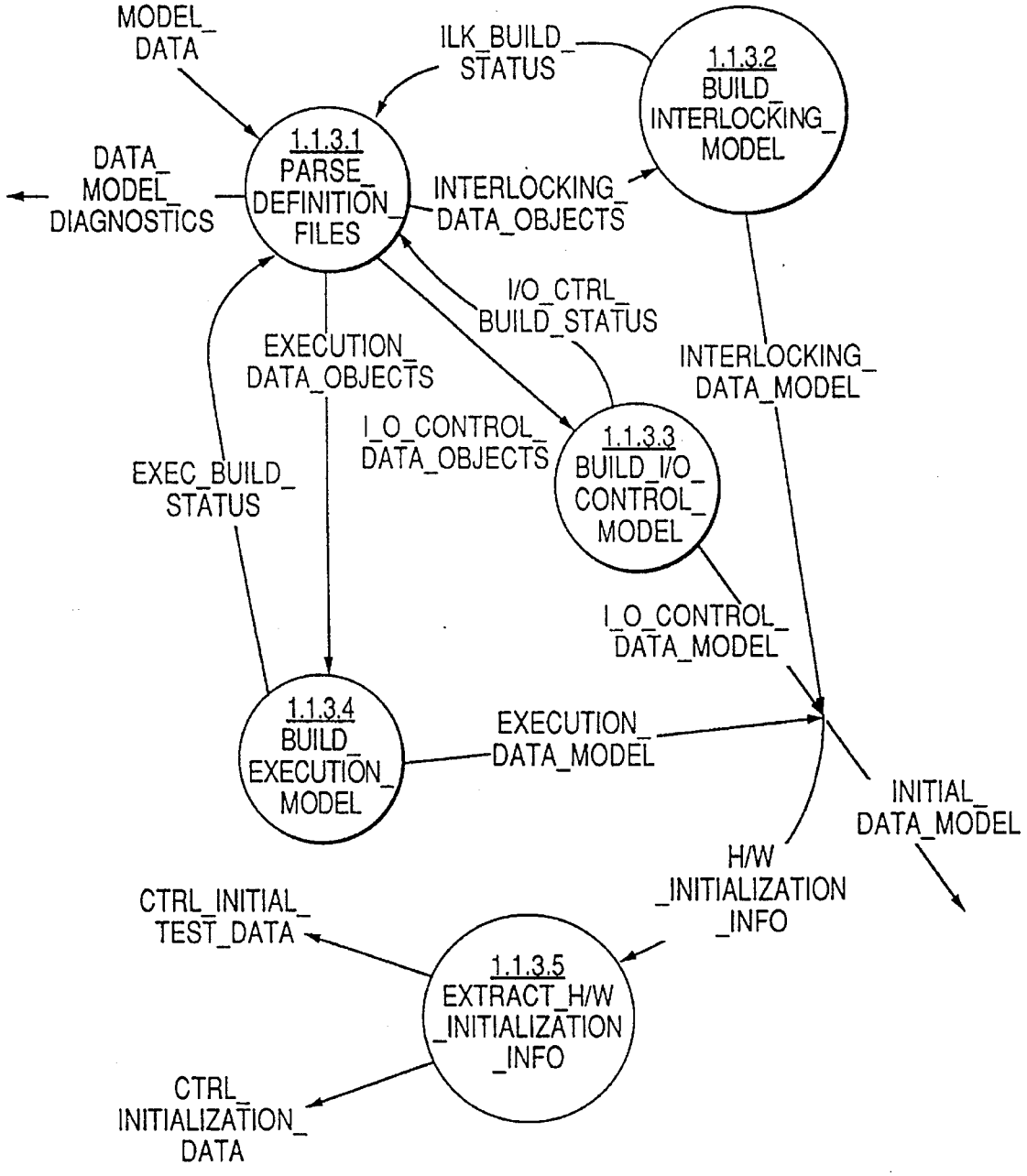

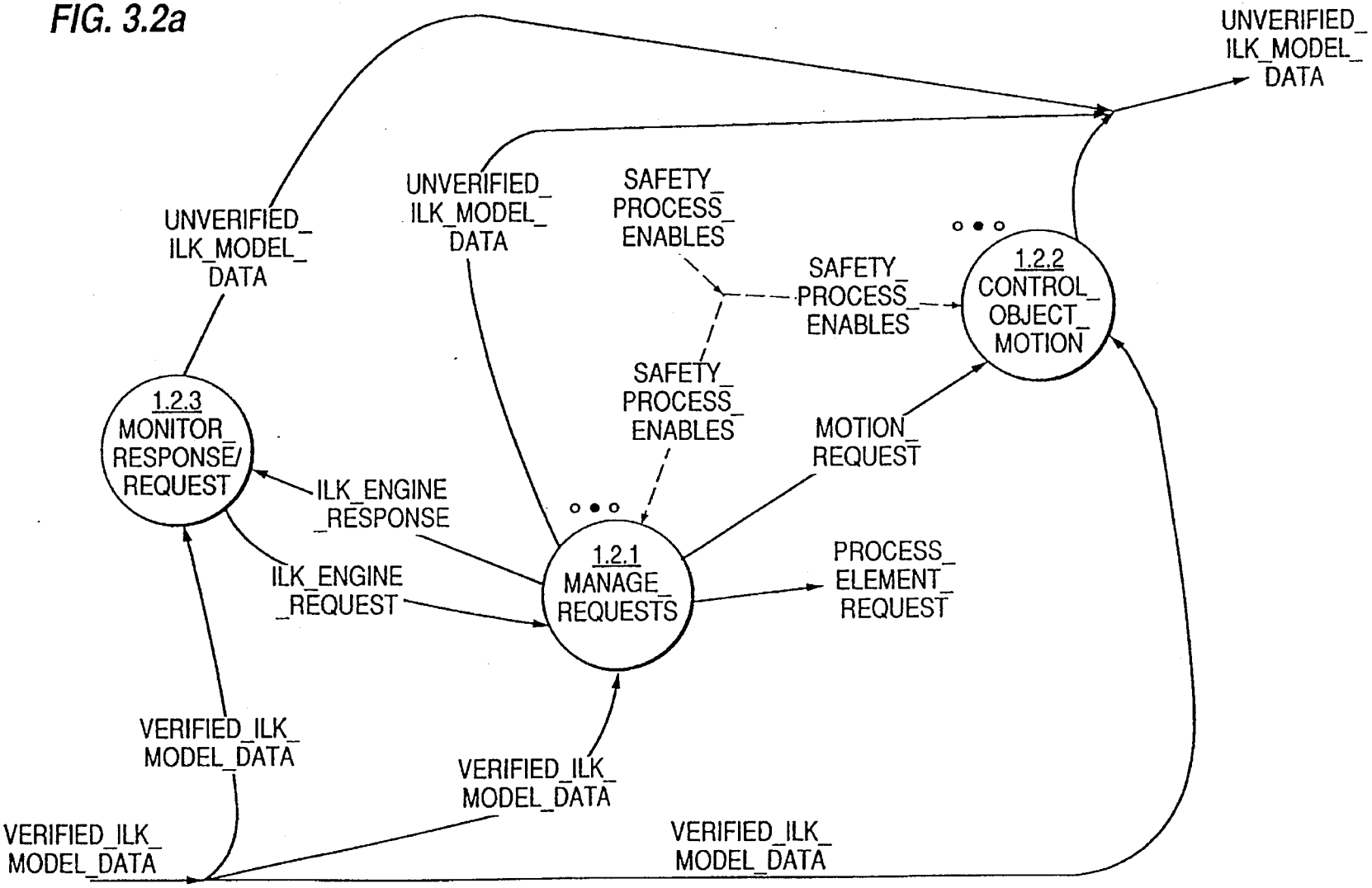
FIG. 3.2a

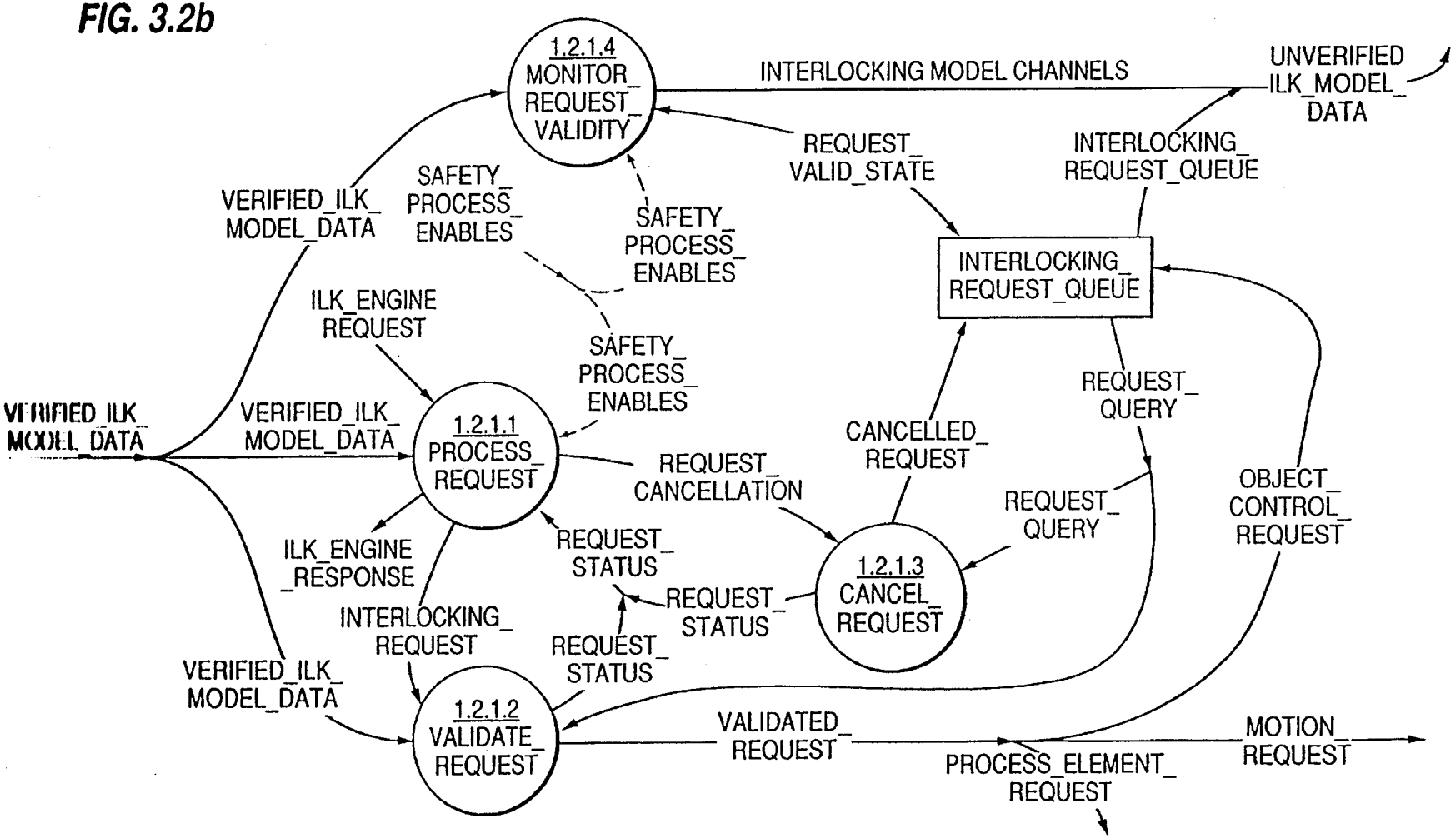
FIG. 3.2b

FIG. 3.2c
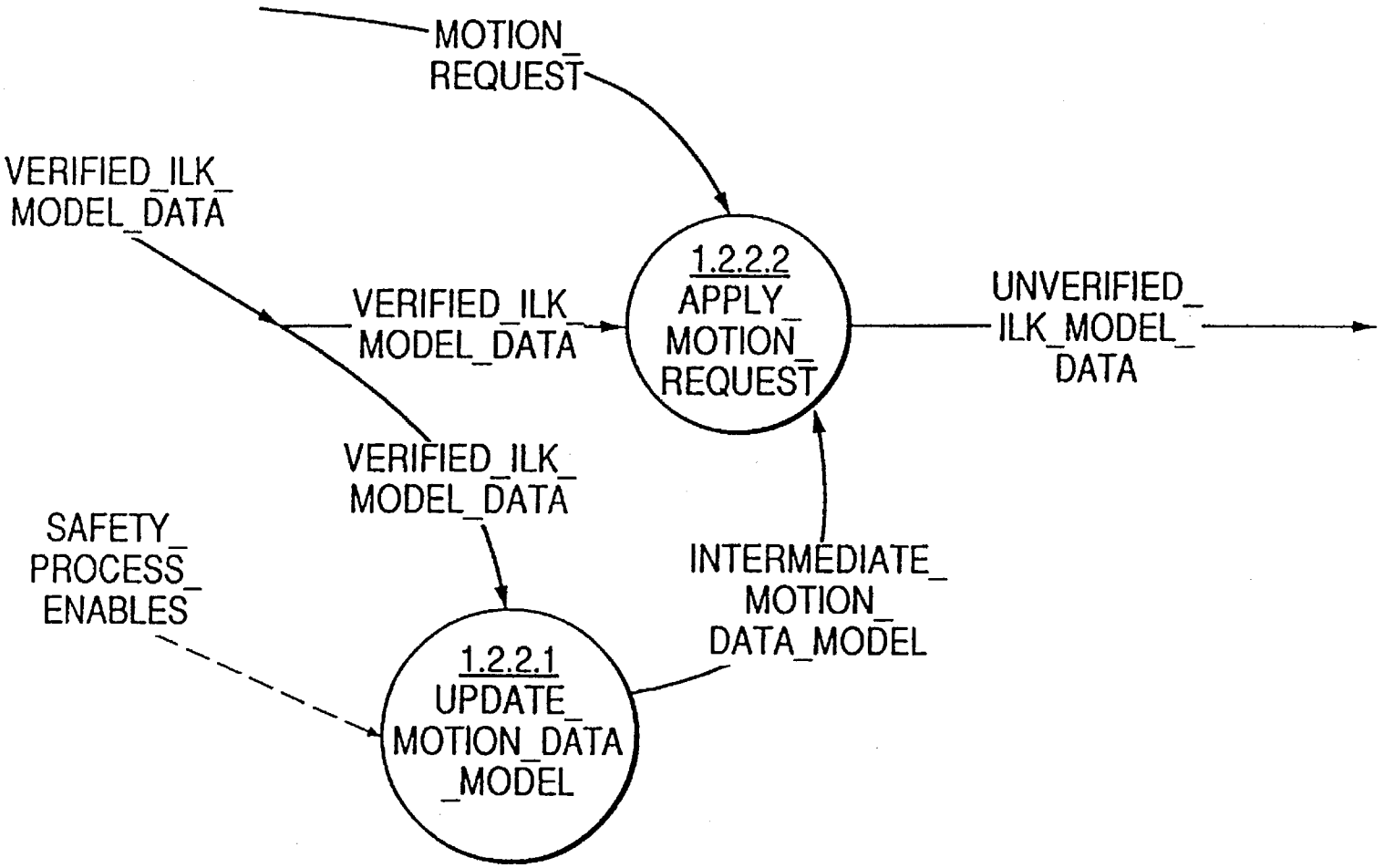

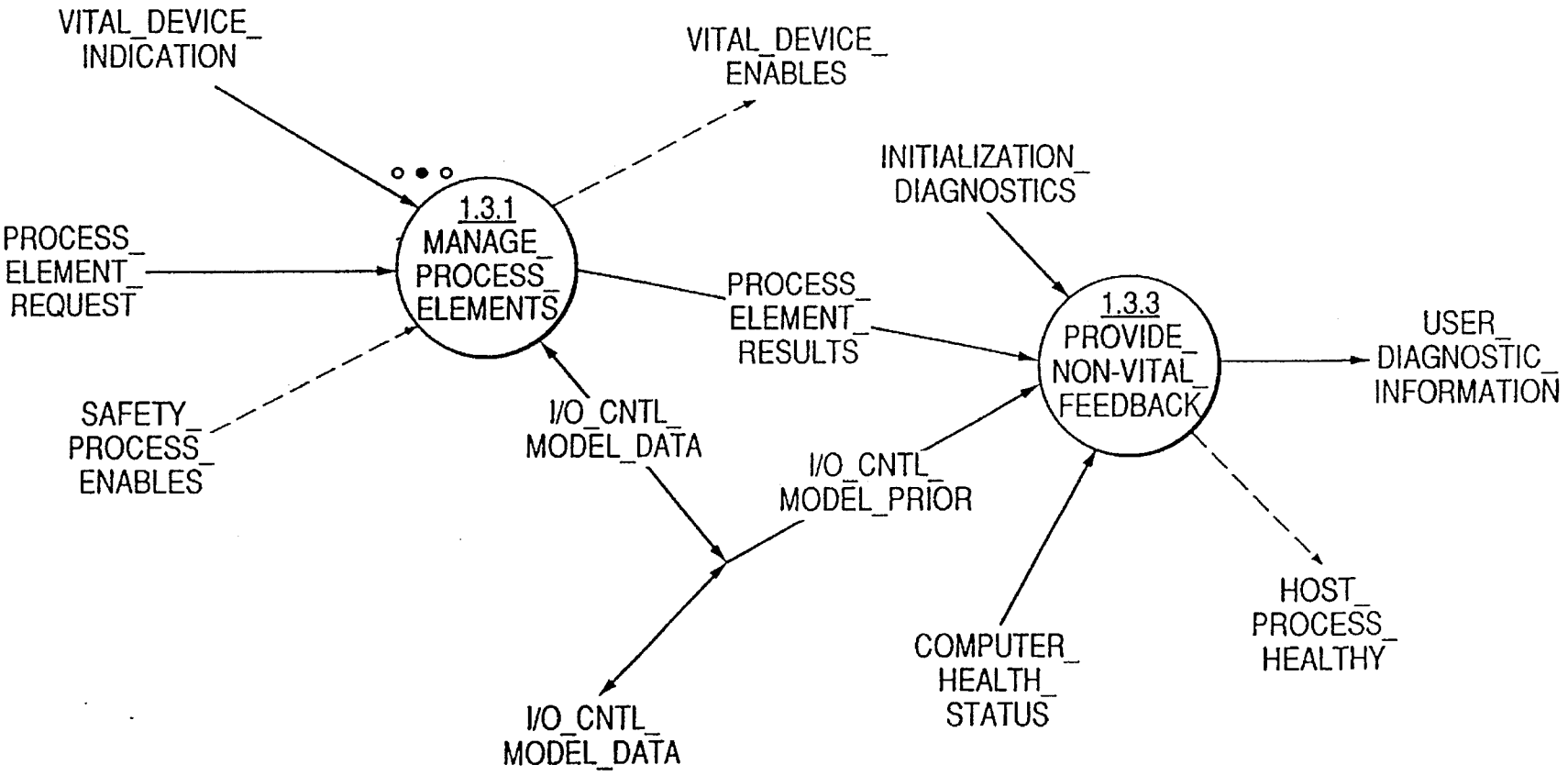
FIG. 3.3a

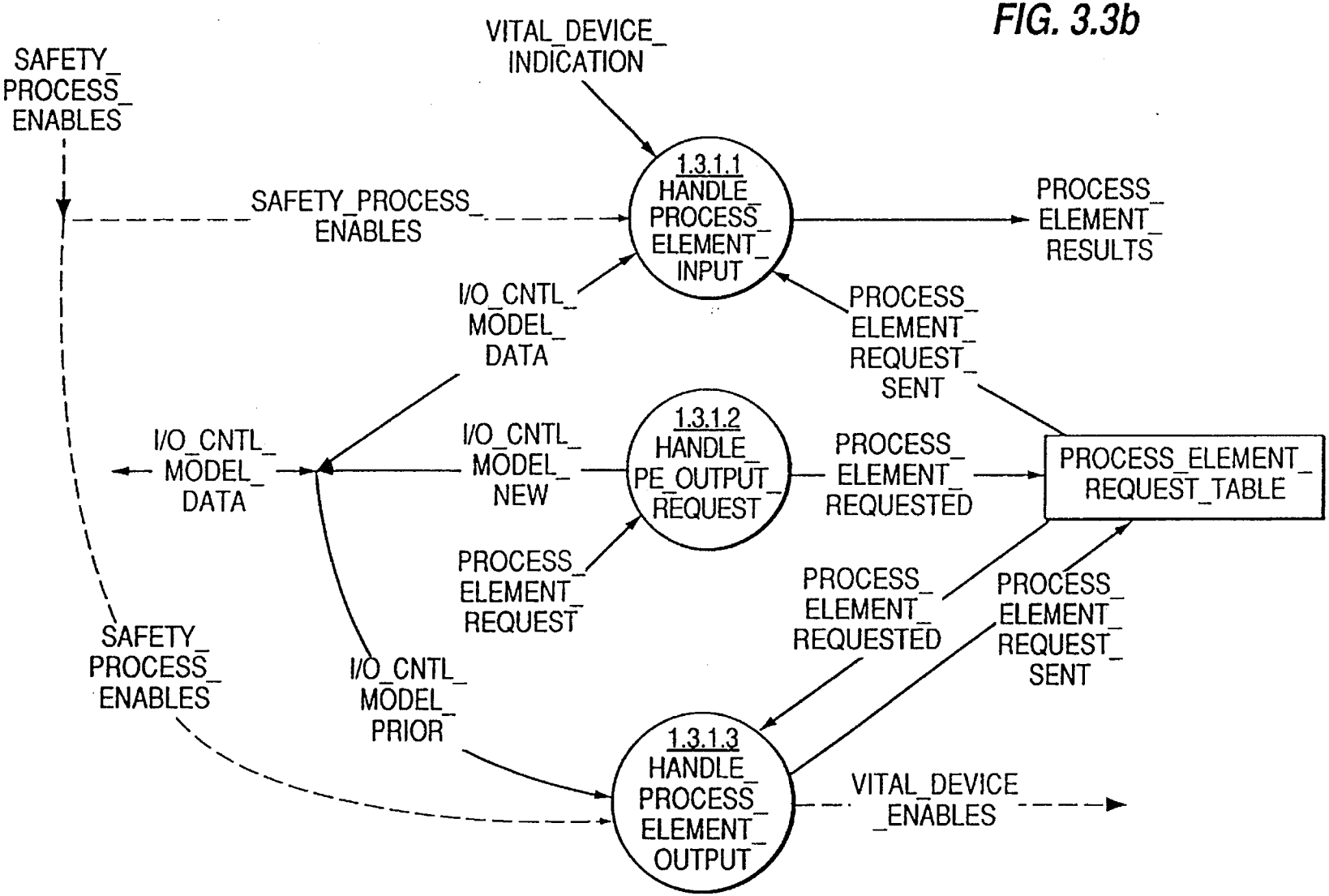
FIG. 3.3b

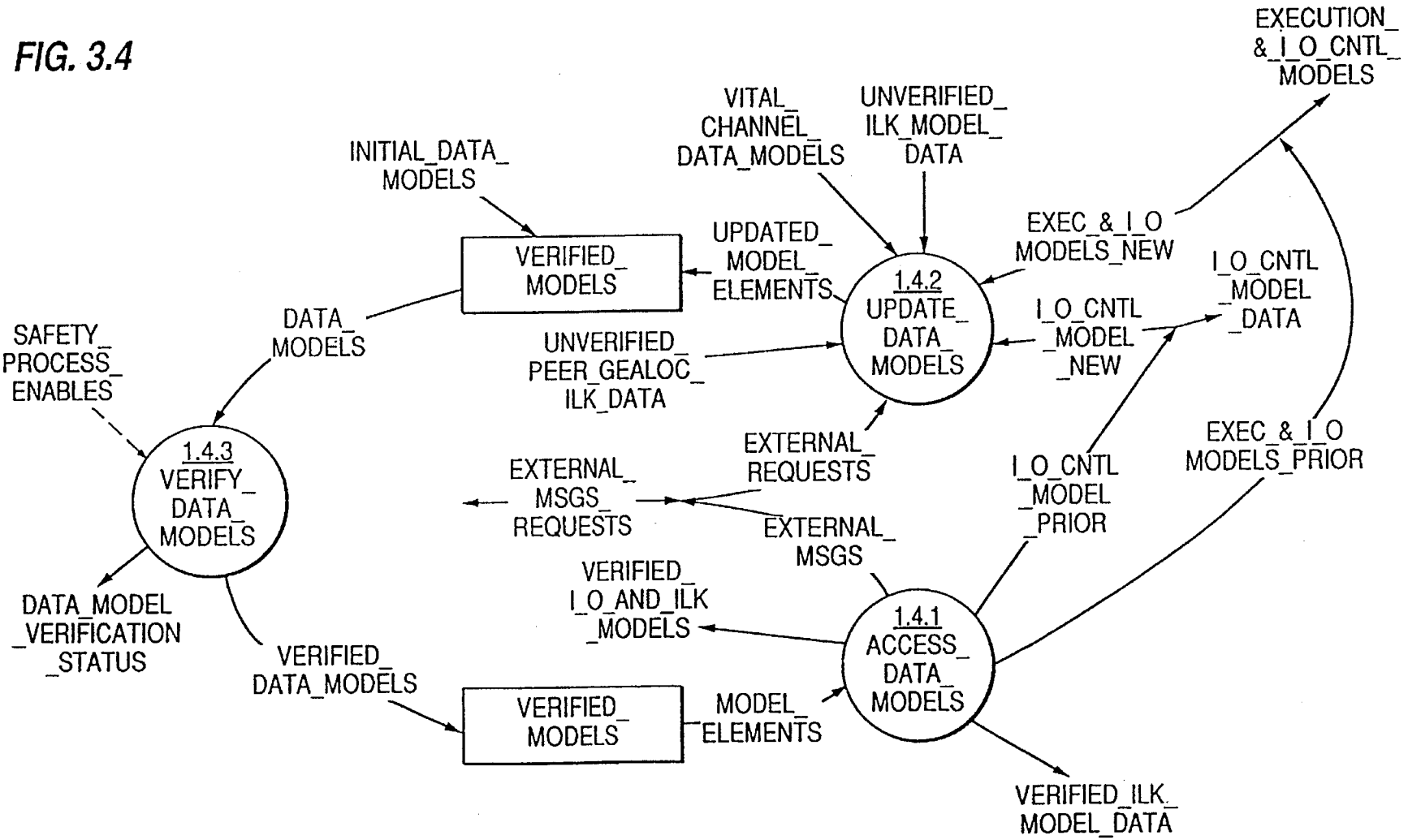
FIG. 3.4

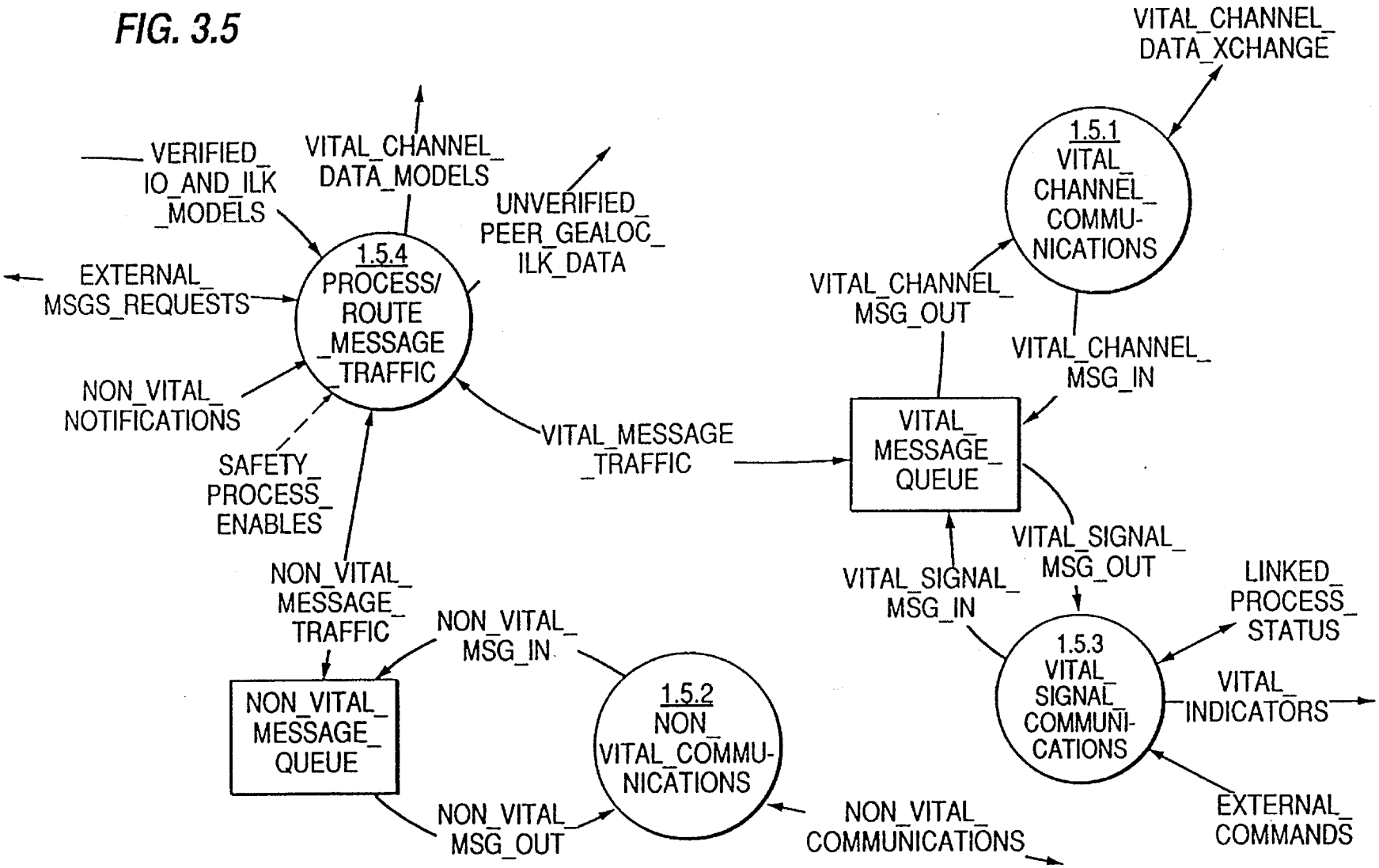
FIG. 3.5

FIG. 3.6a
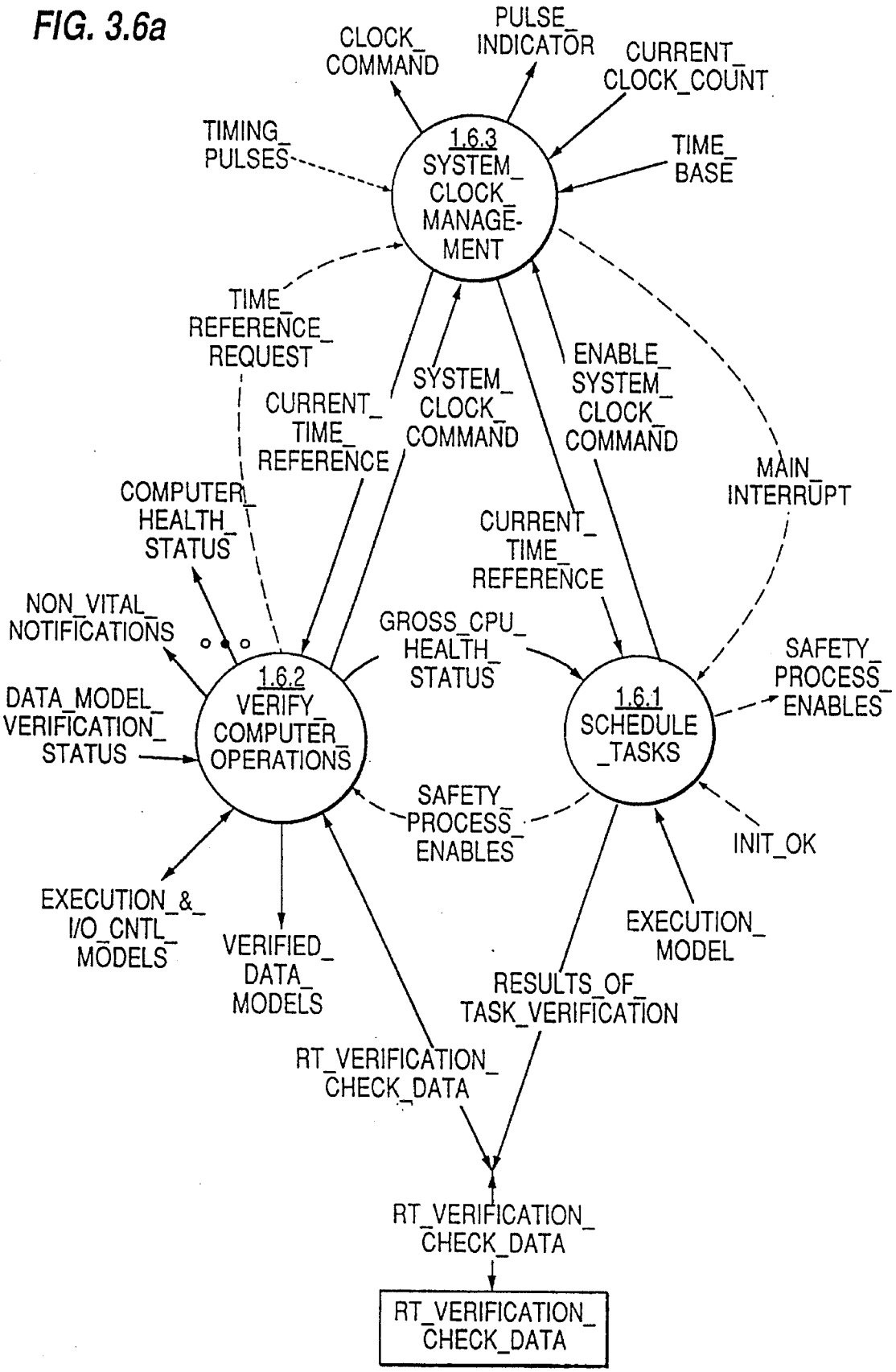

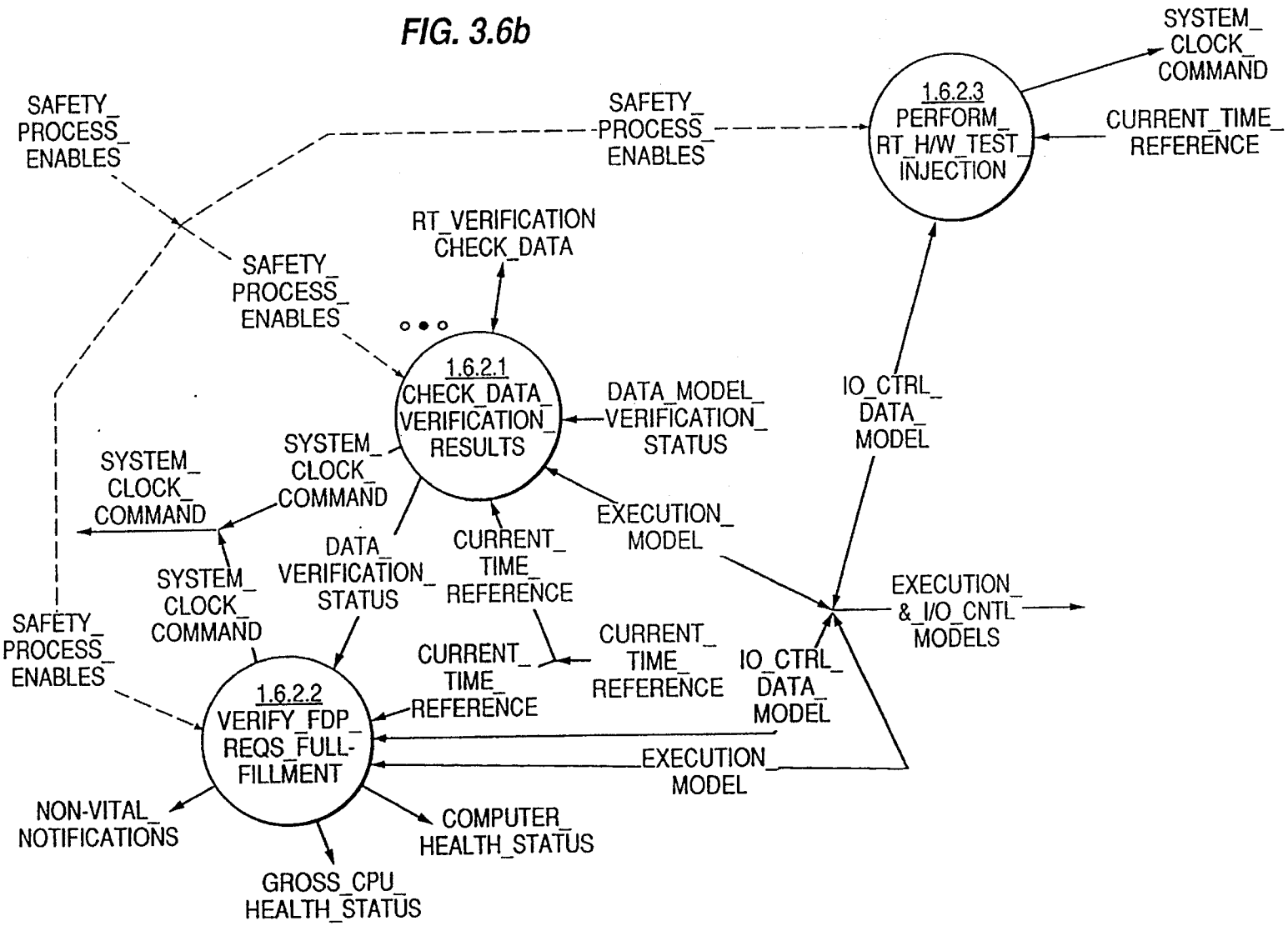
FIG. 3.6b

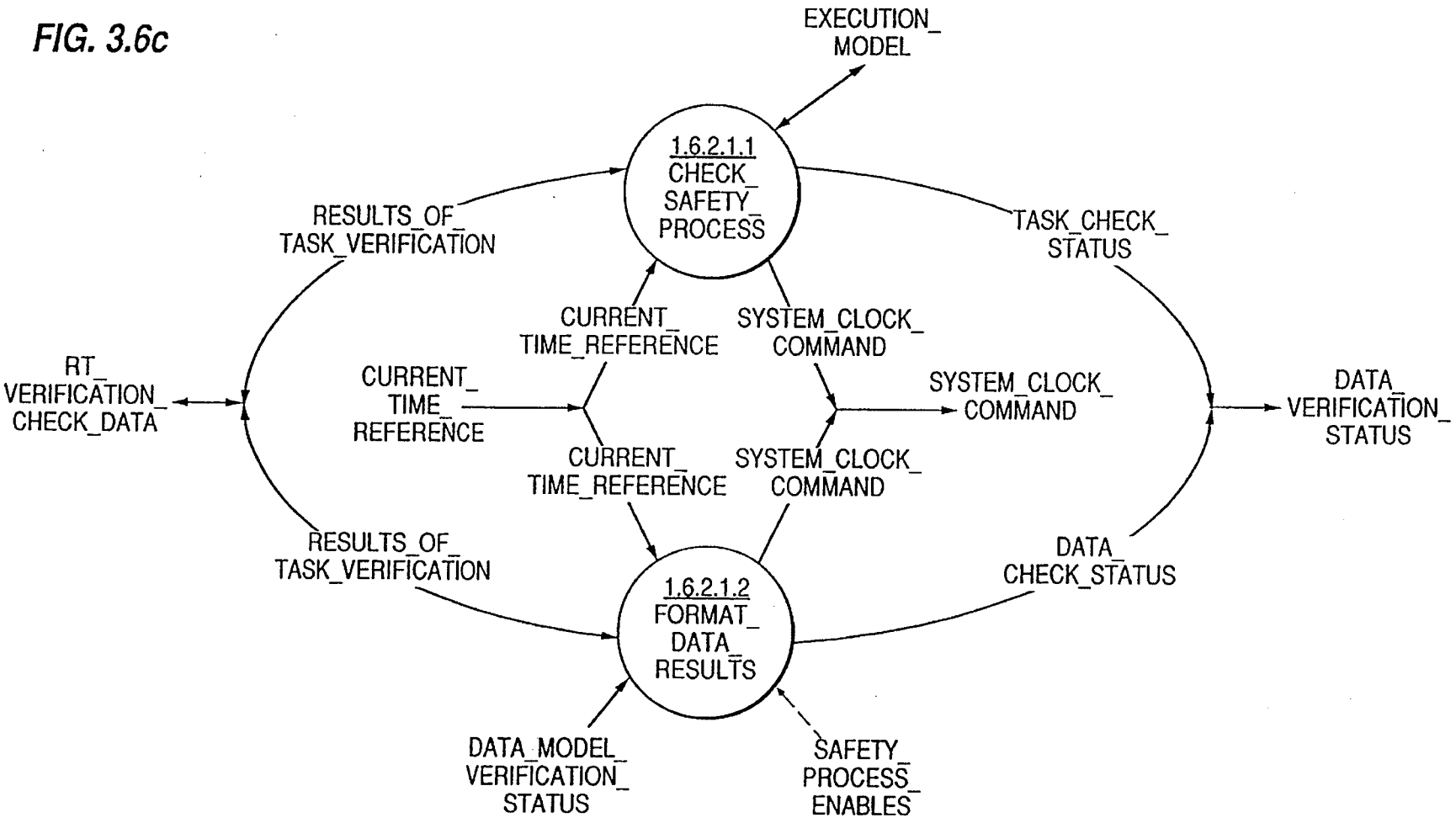
FIG. 3.6c

RULES-BASED INTERLOCKING ENGINE USING VIRTUAL GATES

BACKGROUND OF THE INVENTION

1. Field of the Invention

The invention relates to the field of automatic train protection, and in particular to a computer based method for implementing interlocking system logic.

2. Background Information

One of the greatest challenges in the development of a solid-state interlocking system for automatic train protection is to provide a system that can offer, at a minimum, the identical functionality that exists in a traditional, vital relay based system, while at the same time providing the flexibility and adaptability that is expected of modern-day computer based products. A "vital relay" or "gravity drop relay" is a relay having special characteristics which preclude welding of contact tips. It is mounted in such a way that upon de-energization of the relay coil, gravity will cause the contacts to open.

As the name implies, "automatic train protection" refers to an automatic system for protecting trains traversing a transportation network, automatically avoiding guideway conflicts which could lead to train collisions, and ideally at the same time optimizing guideway utilization and overall train system efficiency. The term guideway refers to the track which guides a train between points A and B. Guideway "objects" are the switches, turntables, scissors cross tracks, etc., through which a train travels on its journey.

The term "interlocking system" as used herein refers to an arrangement of gates and control apparatuses interconnected so that their functions must occur in a predetermined sequence to assure safety. A gate is the boundary point of an interlocked route where entry to a route is governed. A gate is not a device, but rather a point on the guideway.

Some of the current solid-state interlocking systems which have been developed merely attempt to supplant the vital relays with the boolean logic equations representative of the interactions that would occur between the relays as they transition from one state to another.

This type of solution represents an improvement in that it eliminates the expense of the actual relays themselves, their maintenance, etc. However, it does not eliminate the additional steps of having an interlocking engineer design the interlocking system, transform it into representative boolean equations, have it verified by an interlocking design inspector, etc., expensive processes in their own right. In addition, it does not provide the desired flexibility, so that any changes or adaptations made after the fact require the entire process to be repeated.

With the advent of powerful microprocessor technology, several attempts have been made by members of the railroad industry to replace relay-based interlocking systems with solid-state microprocessor-based systems. The more flexible of these systems have, for the most part, performed this function by solving boolean equations or ladder logic representative of the relay-tree diagram created by an interlocking designer.

Some of the problems with this approach are errors in the interlocking logic are difficult to detect, and future changes to the interlocking (e.g., guideway extensions, addition of B-point detectors, etc.) must be carefully implemented into the overall interlocking scheme by an experienced interlocking engineer.

To further complicate matters, since automatic train protection systems are safety-related, any changes to the code executed by the microprocessor usually requires at least a partial re-certification of the system, resulting in a longer system down-time, not to mention other costs associated with obtaining safety certification.

SUMMARY OF THE INVENTION

Therefore, the invention described herein provides a unique approach to implementing a solid-state interlocking system that is both more powerful and more flexible than the conventional methods, while being subject to none of the associated problems. The invention described herein provides a method by which complex interlocking may be refined and modeled such that a computer based system can provide a more complete and flexible solution.

This is accomplished according to one embodiment of the invention, by a method of implementing a computer based interlocking system for automatic train protection, which includes providing a data base of prestored rule sets for a plurality of guideway objects, the rule sets defining conditions for a respective guideway object which must be met before entry to said object is permitted; inputting a high-level description of a guideway system layout including all of the guideway objects that make up guideways in the system; and processing the high-level description using the pre-stored rule sets and input high-level guideway description to form an internal guideway data model.

According to a further embodiment of the invention, the high-level description of a guideway system layout comprises a definition section which describes the entire makeup of the guideway system, including the guideways and corresponding guideway objects, which can influence the motion of trains in the system; a relation section which defines the associations between objects that make up each guideway in the guideway system; a rules section which states the rules which govern exceptional or application specific modifications to standard interlocking situations for the guideway objects that make up the guideway system in relation to the current state of those objects; and an initialization section which permits the setting of values for the guideway objects for use during operation of the computer based interlocking system.

According to another embodiment of the invention, inputting the high-level description of a guideway system layout comprises inputting a definition section which describes the entire makeup of the guideway system, including the guideways and corresponding guideway objects, which can influence the motion of trains in the system; inputting a relation section which defines associations between the objects that make up each guideway in the guideway system; inputting a rules section which states the rules which govern exceptional or application specific modifications to standard interlocking situations for the guideway objects that make up the guideway system in relation to the current state of those objects; and inputting an initialization section which permits the setting of values for the guideway objects for use during operation of the computer based interlocking system.

In a further embodiment of the invention, the processing to form an internal guideway data model comprises parsing the high-level description of a guideway system layout; and locating, retrieving and linking appropriate rule sets and corresponding respective guideway objects thereby forming an internal guideway data model which includes all of the guideway system objects and their interrelationships.

In another embodiment of the invention, the rule sets are based on the Association of American Railways recommended design practices for design of vital relay based interlocking logic circuits.

According to another embodiment of the invention, in a digital computer, a rules based interlocking system for automatic train protection of a guideway includes a guideway data model comprising a plurality of data entries specifying guideway objects, at least some of the guideway objects corresponding to guideway hardware devices, the guideway data model specifying relationships between the guideway objects; a database comprising rule sets for a plurality of guideway objects, the rule sets defining conditions for respective guideway objects which must be met before entry of a train is permitted; a user input guideway definition file comprising a high-level description of the guideway, including the guideway objects; a data model parser for parsing the guideway definition file and producing the guideway data model using the database comprising the rule sets; and I/O control means for sending control signals to the guideway hardware devices and for receiving status signals from the guideway hardware devices based on the guideway data model and sensed status signals.

Another embodiment of the invention is providing a method of implementing a computer based interlocking system for automatic train protection which uses the concept of a "virtual gate." A virtual gate defines an entry point to an interlocking object in the interlocking system. The virtual gate, which may or may not correspond to an actual physical device, i.e., a "real" gate, in the guideway system, provides a convenient way to implement the computer based interlocking system with optimum flexibility.

The method according to an embodiment of the invention includes providing a data base of prestored rule sets for a plurality of guideway objects, the guideway objects being represented as one or more virtual gates of a plurality of virtual gate types, the rule sets defining conditions for a respective guideway object which must be met before entry through a virtual gate of said object is permitted. Then, a high-level description of a guideway layout including all of the guideway objects that form interlocking zones may be input and processed using the pre-stored rule sets to form an overall interlocking system definition, i.e., an internal guideway data model, by locating, retrieving and linking appropriate rule sets corresponding to the respective input guideway objects.

According to a further embodiment of the invention, the objects include simple switches, turntables and scissors crossovers.

In another embodiment of the invention, three types of virtual gates are used to represent a simple switch object, the three types of virtual gates corresponding to the direction of approach to the switch, the direction of approach being one of normal, reverse and tangent.

In another embodiment, a rule set for a simple switch object includes a plurality of conditions for each virtual gate type which must be met for entry through the virtual gate, the conditions comprising an object state condition defining a switch position in which entry through the virtual gate is allowed; at least one opposing gates state condition defining the states that the other virtual gates of the switch must be in for entry through this virtual gate to be allowed; at least one object occupancy state condition defining the occupancy state of the switch in which entry through the virtual gate is allowed; at least one adjoining object occupancy state condition defining the occupancy states any adjoining objects must be in for entry through the virtual gate to be allowed; and at least one adjoining object direction of travel state condition defining the travel direction states any adjoining objects must be in for entry through the virtual gate to be allowed.

According to another embodiment of the invention, the rule sets are based on the Association of American Railways recommended design practices for design of vital relay based interlocking logic circuits.

According to another embodiment of the invention, in a digital computer, a rules based interlocking system for automatic train protection of a guideway includes a guideway data model comprising a plurality of data entries specifying guideway objects, at least some of the guideway objects corresponding to guideway hardware devices, the guideway objects being represented as one or more virtual gates of a plurality of virtual gate types, the guideway data model specifying relationships between the guideway objects; a database comprising rule sets for a plurality of guideway objects, the rule sets defining conditions for respective guideway objects which must be met before entry of a train through a virtual gate is permitted; a user input guideway definition file comprising a high-level description of the guideway, including the guideway object; a data model parser for parsing the guideway definition file and producing the guideway data model using the database comprising the rule sets; and I/O control means for sending control signals to the guideway hardware devices and for receiving status signals from the guideway hardware devices based on the guideway data model and sensed status signals.

Another embodiment includes forming a database representing a guideway in a computer based interlocking system, comprising, dividing a guideway into a plurality of guideway objects, for each of the plurality of guideway objects, representing each entry point into the guideway object as a virtual gate of a plurality of virtual gate types, storing a rule set for each virtual gate type, the rule sets specifying virtual gate entry condition requirements, and associating the rule sets with the respective virtual gates of the plurality of guideway objects.

And a further embodiment includes representing a simple switch as a guideway object in a computer based guideway control system, wherein the simple switch is divided into a plurality of virtual gates, comprising for each virtual gate type, storing an object state condition defining a switch position in which entry through the virtual gate is allowed storing at least one opposing gates state condition defining the states that other virtual gates of the switch must be in for entry through this virtual gate to be allowed, storing at least one object occupancy state condition defining the occupancy state of the switch in which entry through the virtual gate is allowed, storing at least one adjoining object occupancy state condition defining the occupancy states any adjoining objects must be in for entry through the virtual gate to be allowed, and storing at least one adjoining object direction of travel state condition defining the travel direction states any adjoining objects must be in for entry through the virtual gate to be allowed.

BRIEF DESCRIPTION OF THE DRAWINGS

The invention may be better understood from the following description of a preferred embodiment taken together with the drawings in which.

DETAILED DESCRIPTION OF THE PREFERRED EMBODIMENTS

In an embodiment of the invention as shown in FIG., 1*a*, a data base of rule sets for each type of guideway object are created and stored in the system (step 101), a complete guideway description is input (step 102) and parsed (step 103), guideway objects and corresponding rules sets are linked and an internal guideway data model is thereby created (step 104) and stored (step 105) for the system.

Figure 1A:
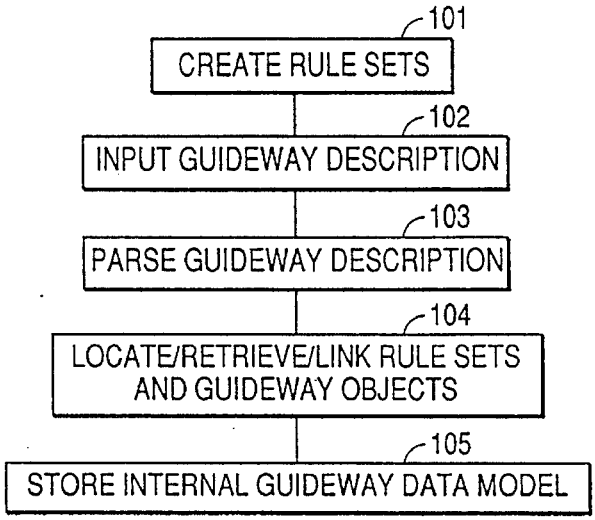
FIG. 1*a* shows a flow chart of an embodiment of the invention.
Figure 1B:
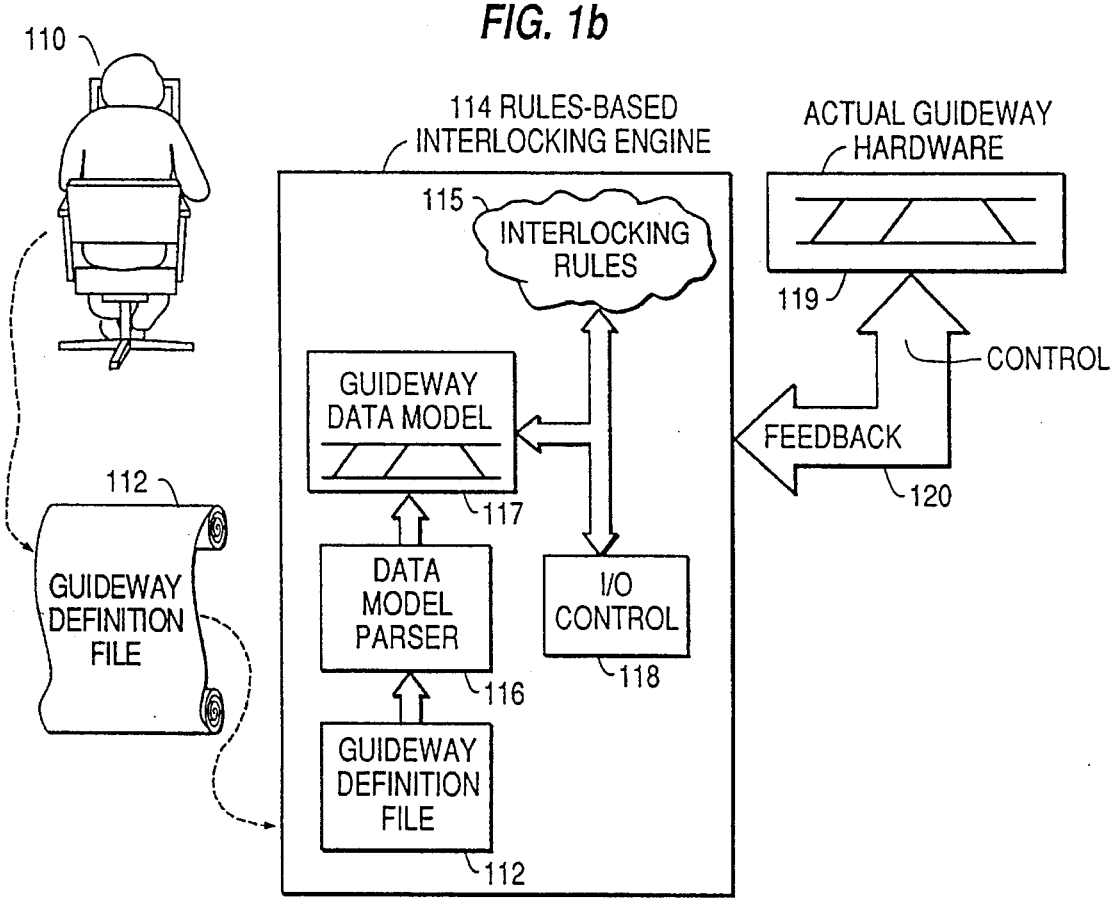
FIG. 1*b* shows how an embodiment of the invention is used.

FIG. 1*b* shows how an embodiment of the invention is used according to the above method. A user 110 creates the Guideway Definition File 112 for the particular application and inputs it into a digital computer wherein the Rules-Based Interlocking Engine 114 processes it using interlocking rules 115 with Data Model Parser 116 to form and store an interlocking data model 117. I/O control 118 monitors and controls 120 the actual guideway hardware 119 using the guideway data model 117.

Figure 2:
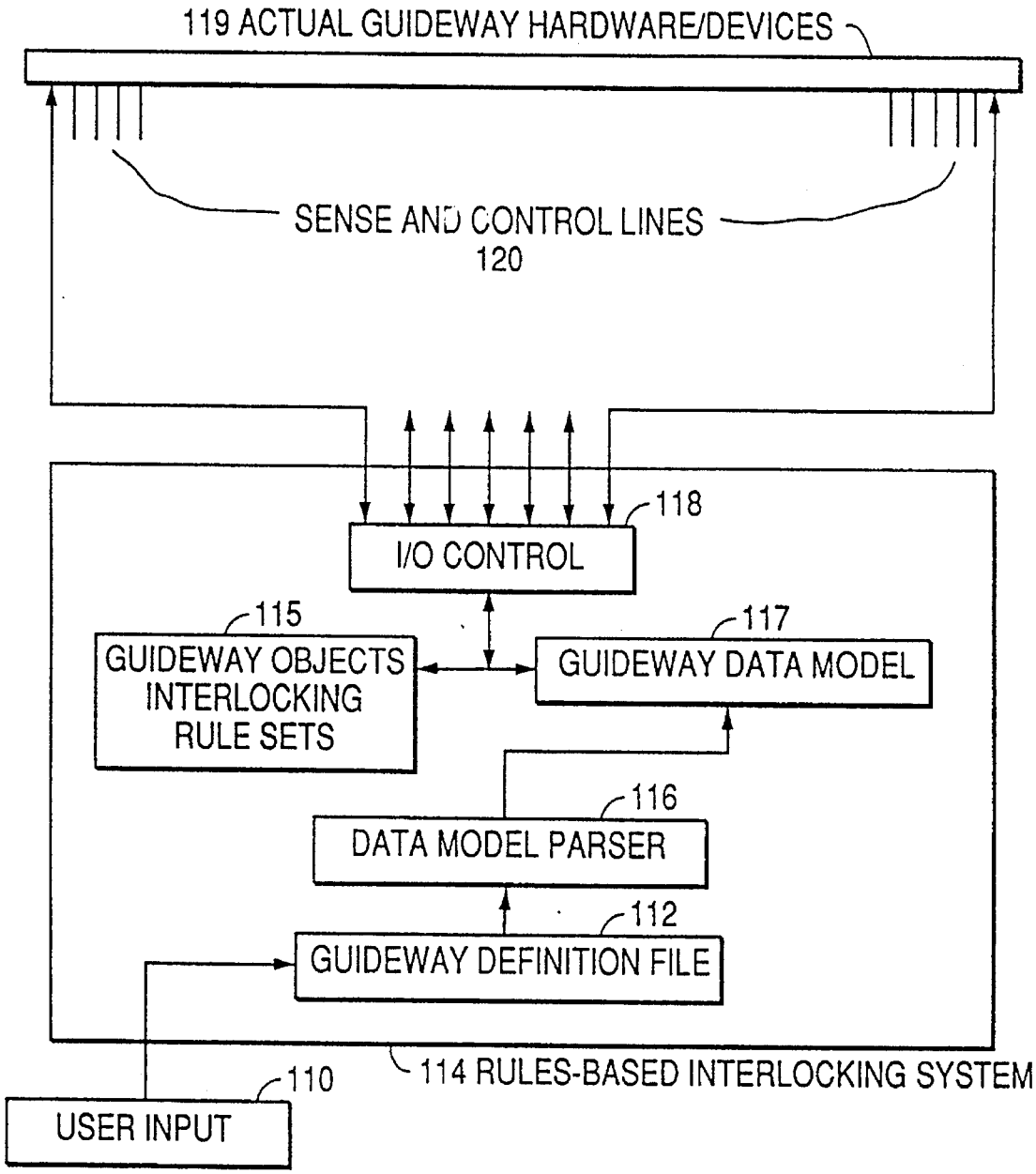
FIG. 2 shows a rules-based interlocking system according to an embodiment of the invention.

FIG. 2 shows an embodiment of a rules based interlocking system 114 according to the invention. The actual guideway hardware devices 119 interface with the system over sense and control lines 120 through I/O control block 118. Control is accomplished using the guideway data model 117 stored in memory. A user can update the guideway data model 117 through inputting changes to the guideway definition file 112 through a user input device 110, such as a terminal. The data model parser 116 processes the guideway definition file 112 and produces the guideway data model 117. Also stored in the system are guideway objects interlocking rule sets 115 which define the requirements for safe entry to a guideway object.

In one embodiment of the invention, a complete description of the guideway to be controlled is placed in a Guideway Definition File, also referred to herein as Application Definition File or Data Model Definition File, in plain ASCII text. This file will be parsed to construct a complete data model for the interlocking system. The Guideway Definition File describes the transportation system to be controlled to the Rules-Based Interlocking Engine (RBIE), which then applies the appropriate rules to the data objects described therein to provide safe control.

An example of the contents of such a Guideway Description File for the vital control of an Automated People Mover System is provided in the attached Appendix. The example is not complete, details not required for an understanding of the invention having been omitted in the interests of saving space.

The Guideway Description File is divided into several sections in the preferred embodiment, including an Object Definition Section, a Relation Section, a Rules Section and an Initialization Section, each of which has a specific purpose, as will now be described.

The Object Definition Section of the Guideway Definition File, begins where indicated in Appendix page A1 by the keyword "DEFINITION." This section is used to describe/define all of the elements or "objects" of the guideway which in some manner impact the safety of the system and the associated control of train motion. In this sample application, there are two major object types: "TRACK_CIRCUIT" and "MEMBER" as indicated by the appearance of these keywords in the definition section. The completion of the Object Definition Section is indicated by the keyword "END" on Appendix page A4 Comments are preceded by ";" in the sample shown.

The object definitions themselves consist of an object sub-type and an object name. The name is used later in the Relations section to build the relationships between the objects. For example, as shown in the Appendix pages A1 to A4, the object type keyword "TRACK_CIRCUIT" begins a block of data which defines a single guideway. A track circuit is a device which indicates whether a track section is clear or occupied, e.g., on the basis of changes in voltage, current, frequency, or phase position generated by axle short-circuiting.

On Appendix page A1, a block of entries begins "TRACK-_CIRCUIT" and ends "END ;SOUTH GUIDEWAY." The entries "A004, A005. . . " are user defined names for the objects.

The "NORTH GUIDEWAY" is defined with the entries after "TRACK_CIRCUIT", e.g., "B122", "B118" etc., as shown on page A2. The next data begins after the comments: ";DEFINE MEMBERS ;DEFINE STATIONS." Each member definition begins with the object type keyword "MEMBER" and ends with the keyword "END." Each member station is defined by two lines of data, the first line "STATION" is the object sub-type identifier, defining it as a station, and the second line, e.g., "ST1_ARV," is the user defined object name. This user defined name may indicate whether it is an arriving or departing station, e.g., "ST1_ARV" and "$ST1_{13}$ DEP" respectively, or may indicate whether it is an arrival/departure termination station, e.g., "TERM_ARV" or "$TERM_{13}$ DEP" depending on the application.

Member gates are next defined by object sub-type and user defined object name, e.g., "$GATE_{13}$ N" "$A_{13}$ B006" as shown on page A3. Then the switches are likewise defined as shown, "SWITCH_REVERSE" "SW1" for example, which means that switch number one is a "reverse" type switch and "SWITCH_NORMAL" "SW3" which means switch three is a "normal" type switch. The terms "normal" and "reverse" are related to the switch placement on the guideway relative to the travel directions established for the guideway in question. They are used by the RBIE in the application/evaluation of the rules and objects.

As shown on page A5, beam and door MEMBER object sub-types are next defined, e.g., "BEAM" "X1_A." The term "BEAM" refers to an infrared detector typically used on the guideway near the entry points to switches, or in other areas, to act as an independent method of determining whether or not a vehicle occupies the area (i.e., by "breaking" the beam). This object's state is important in determining occupancy and therefore impacts gate requests, switch movement requests, etc. The terms "DOOR" and "PLATFORM_DOOR" "ST1_ARV$_{13}$1" refer to actual doors that passengers could use to enter the guideway area at different locations. This object's state is important in controlling vehicle movement, since any doors not in a closed/locked state will cause the RBIE to prevent the movement of automatic vehicles into the area of the guideway near the doors, as determined by the doors' relationships to certain track circuits.

The Relations Section follows, as shown on pages A5 to A10, in which the interrelationships between the guideway objects are defined. The Relation Section is used to build associations between the objects, i.e., a track circuit is associated with a particular gate, and/or a particular station, etc., the state of which at any given time influences the ability of trains to safely occupy the track circuit. The Relations section begins with the keyword "RELATION" on page A5 and ends with an keyword "END" on page A10.

The "relationship" definitions themselves are constructed by first identifying the object type and name for a "base" object to which relationships are to be made. Then the object type and name of each object to be related to the "base" object is presented as two lines, followed by an "END" keyword indicating the end of the object relation. Another "END" keyword thereafter indicates the end of this relationship definition, i.e., completion of the definition for the current "base" object. This format is repeated as necessary until all the relationships are constructed.

For example, on page A5, the south guideway track circuit objects relationships are defined. The relationship definition:

```
TRACK_CIRCUIT
    A005
        GATE_R
        D_A007
    END
END
```

relates "base" track circuit object type (TRACK_CIRCUIT) having the user defined object name "A005" with a gate object type (GATE_R) having the user defined object name "D_A007."

Referring to page A8, an example of an object with many relationships is illustrated. The base object type keyword and user defined object name, "SWITCH_REVERSE" and "SW1" respectively, are followed by a number of object type/name pairs setting forth the relationship definition for the "base" object. Since each object may have many relationships with other objects, those objects in turn having many relationships with other objects, according to the invention, complex relationships are easily established in that an individual object "inherits" the relationships of any the objects to which it is related in its relationship definition.

The next section, the Rules Section, as shown on page A11, may also optionally be included. This section can be used to identify exceptional or application specific modifications to the standard interlocking situations. In this section, additional linkages to objects can be made which also define a specific state that the object must be in during evaluation in order for a safe state to be achieved. The "rule" is presented as a single line entry. The entry includes "base" object type, "base" object name, "linked" object type, "linked" object required state, and "linked" object name.

For example, as shown on page All, "GATE_R B_B006 TC CLEAR=B000" indicates that the "base" object type/name "GATE_R B_B006" is related to "linked" track circuit (TC) with "linked" object name "B000" such that the "linked" object required state is "CLEAR." Similarly, "GATE_N C_A007 TC CLEAR=A004" means "base" object gate "C_A007" is related to "linked" object track circuit "A004" such that the required "linked" object state is "CLEAR."

Finally, the last section in the definition file, also optional, is the Initialization Section, as also shown on page A11. This section may be used to set the initial values/states of objects in the system, if it is so desired. In this section, specific attributes of selected objects in the system may be initialized to other than default values. This is particularly helpful in cases where a system, for example, which was previously constructed of hardware components only, is converted to a computer based system and the resulting speed increase results in synchronization problems, etc. The initialization entry is presented on a single line, including object type, object name, element within the object to initialize, and the initialization value.

For example, as shown on page A11, "GATE_R B_B006 TIMER =30" means initialize the timer in gate "B_B006" to a value of 30. Similarly, "GATE$_{13}$ N C_A0007 TIMER=45" means initialize the timer of gate "C_A007" to a value of 45.

As mentioned above, the information in the Guideway Definition File is parsed by the system, with the information provided being used to construct an internal Guideway Data Model consisting of all of the system's objects and their interrelationships.

Rather than having a fixed equation to evaluate for each interlocking situation, the processing component of the system, also referred to as the Rules-Based Interlocking Engine, contains sets of pre-defined rules pertinent to the safe manipulation of each type of object that can be used to form a guideway (simple switch, scissors cross track, etc.).

The rules are based on an interpretation of the Association of American Railways (AAR), Signal Section (sometimes Communication and Signal Section) recommended design practices, as set forth in a series of technical booklets each being a chapter of "American Railway Signaling Principles and Practices" hereby incorporated by reference, upon which the design of vital relay based interlocking logic circuits are normally based. The series of booklets cover practically everything from the history of railway signaling to central control technology. An interested reader should consult in particular Chapter XVI, Interlocking; Chapter XIX, Interlocking Circuits; Chapter XX, Electric Interlocking; and Chapter XXVI, Relay Interlocking in particular. Chapter XII, Semaphore Signals and Chapter XXIII, Railroad-Highway Grade Crossing Protection, cover additional protection mechanisms. Additional information is presented in Chapter I, History and Development of Railway Signaling, and Chapter IV, Centralized Traffic Control, Part 2.

An example of an implementation of such a set of rules for a simple switch, using the "virtual gate" concept according to the invention will now be described. In order to explain the invention, simple switches will be used as examples of guideway signalling devices, also referred to interchangeably as "guideway objects" in the following description, however the invention is not intended to be limited thereby to the described example.

Figure 7:
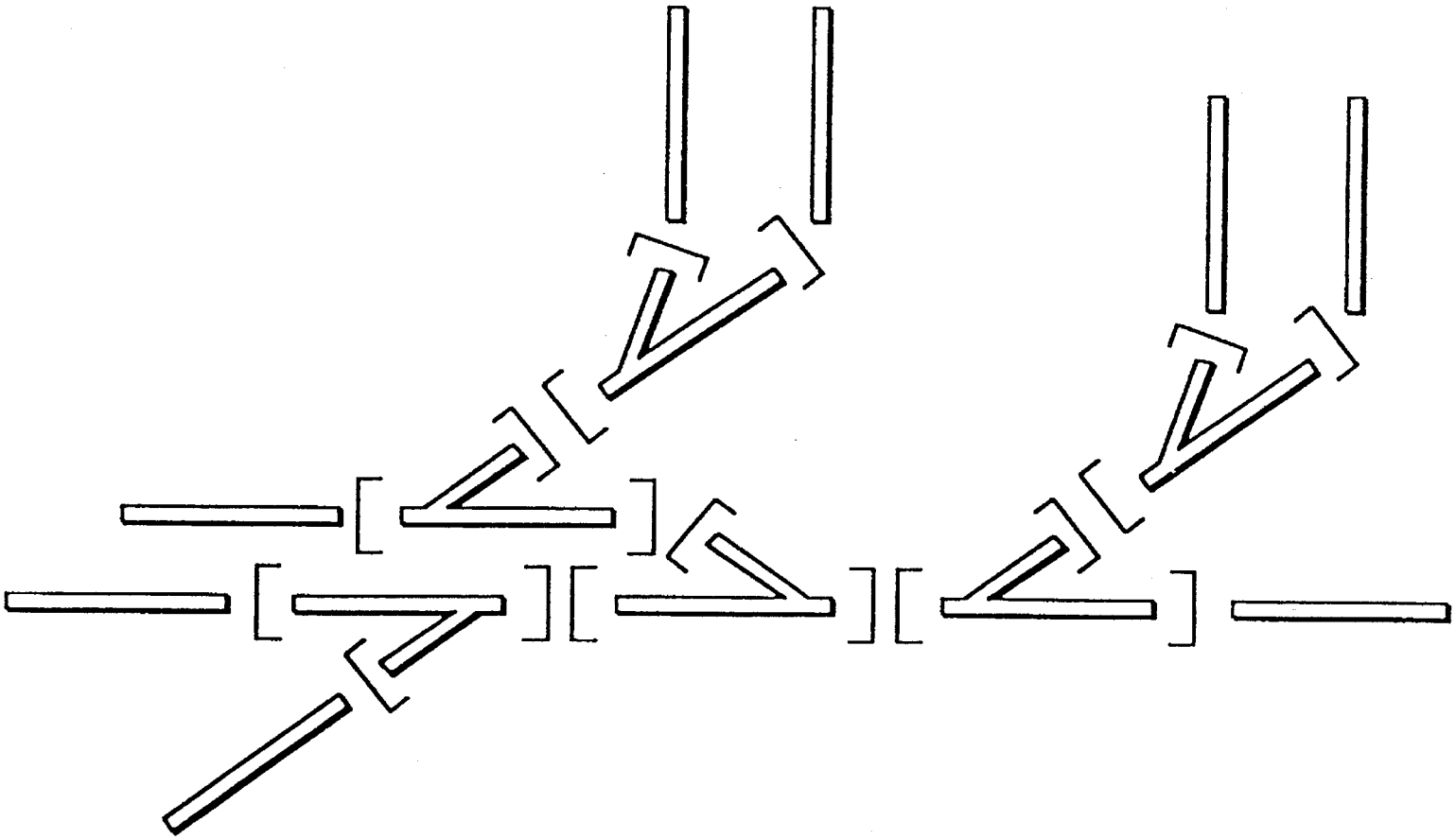
FIG. 7 shows a group of simple switches forming a complex interlocking region as a collection of virtual gates.

In order to enable a computer to perform interlocking without needing to process an elaborate boolean equation, it is first necessary to refine a seemingly complex interlocking zone (such as illustrated in FIG. 7) into its component parts, i.e., objects. Then a set of rules is derived which must be enforced to protect a component part, while also allowing it to be combined with other component parts to effectively provide a safe interlocked zone, as would be provided by conventional vital relays.

Figure 4:
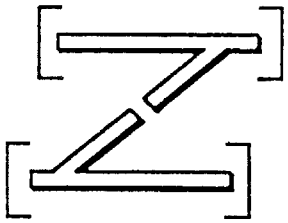
FIG. 4 shows an interlocking region having two simple switches to illustrate the concept of "guideway objects" corresponding to actual signaling devices on a guideway.
Figure 5:
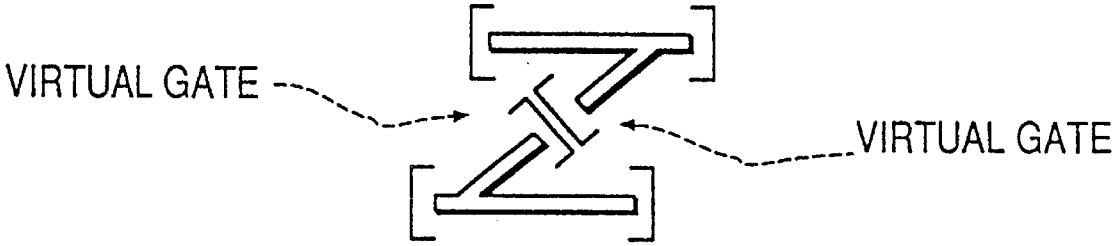
FIG. 5 illustrates the concept of "virtual gates" using the interlocking region of FIG. 4.
Figure 8:
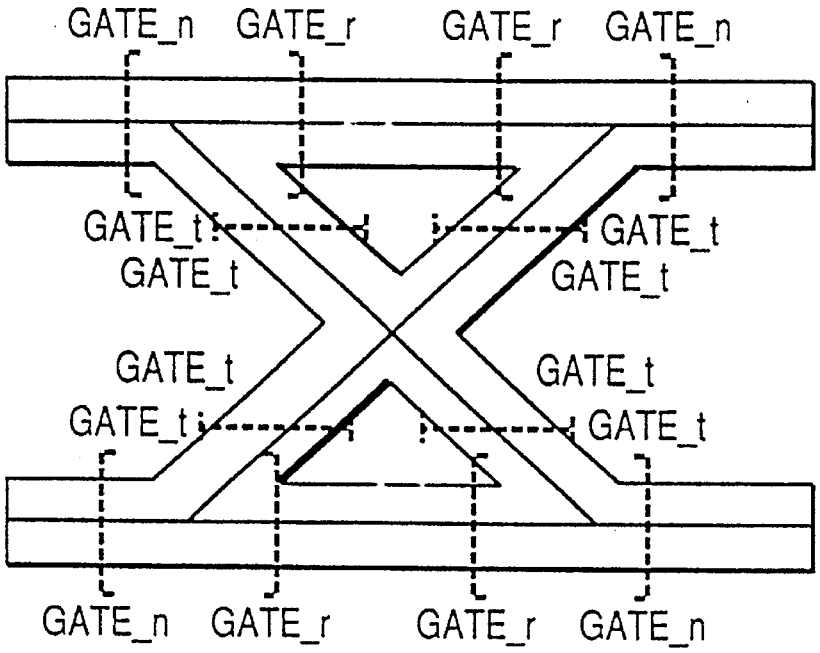
FIG. 8 shows a scissors cross-over and the corresponding virtual gates.
Figure 9:
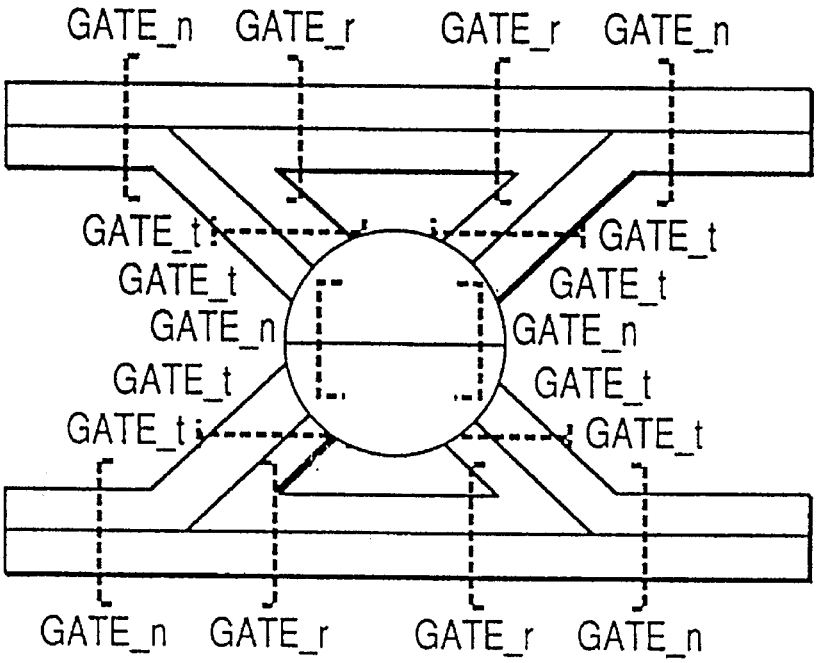
FIG. 9 shows a scissors cross-over with a Roundtable and the corresponding virtual gates.

Protection is afforded an interlocking region through the concept of gates, which usually relate to actual signaling devices on the guideway (see FIG. 4). Through the application of the concept of a Virtual Gate (see FIG. 5), which need only exist in the realm of the interlocking computer but may also correspond to a "real" gate, every possible entry point into an interlocking "object," e.g., a simple switch, can be protected. Furthermore, a series of rules may be defined that govern the behavior of each unique gate "type," both when considered alone and when combined with other "types" of gates. To illustrate this concept, the example of the simple switch (FIG. 6) is used in this description, however, the invention is not intended to be limited thereby to the described example and is applicable to other objects, as shown in FIGS. 8 and 9.

Figure 6:
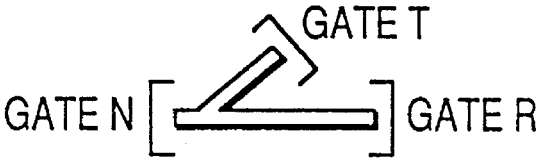
FIG. 6 illustrates the three types of virtual gates defined by the direction of approach, i.e., Normal, Reverse and Tangent, for a simple switch.

Three types of gates are defined for the simple switch by the direction of approach, these being "gate N," "gate R," and "gate T," (for Normal, Reverse, and Tangent approach, respectively, see FIG. 6). Once the virtual gate types have been assigned for the switch, a set of rules is carefully determined.

For a "gate R" type gate request (a request to enter the switch from the Reverse direction) to be granted safely, the following conditions must be met:

1. Object (Switch) State

Entry through a "gate R" can safely occur only if switch alignment is in the normal locked position.

2. Opposing Gates

Entry through any gate is only safe when the other gates protecting an object (switch) are closed; in the case of this object, the switch shown in FIG. 6, "gate N" and "gate T" must be closed.

3. Object Occupancy

Entry through any gate is only safe when the object, e.g., switch, protected by the gate is unoccupied.

4. Adjoining Object Occupancy

Since entry through "gate R" results in exit through "gate N," the object, e.g., switch, adjoining "gate N" must be unoccupied.

5. Adjoining Object Direction of Travel

Since entry through "gate R" results in exit through "gate N," the object, e.g., switch, adjoining "gate N" must have a direction of travel associated with it that is not aligned against the direction of travel associated with the object protected by the "gate R".

For a "gate T" type gate request to be granted safely the following conditions must be met:

1. Object State

Entry through a "gate T" can safely occur only if switch alignment is in the reverse locked position.

2. Opposing Gates

Entry through any gate is only safe when the other gates protecting an object are closed; in the case of this object, the switch of FIG. 6, "gate N" and "gate R" must be closed.

3. Object Occupancy

Entry through any gate is only safe when the object protected by the gate is unoccupied.

4. Adjoining Object Occupancy

Since entry through "gate T" results in exit through "gate N," the object adjoining "gate N" must be unoccupied. In addition, the object adjoining "gate R" must be unoccupied to avoid the possibility of sideswiping another vehicle.

5. Adjoining Object Direction of Travel

Since entry through "gate T" results in exit through "gate N," the object adjoining "gate N" must have a direction of travel associated with it that is not aligned against the direction of travel associated with the object protected by the "gate T".

For a "gate N" type gate request, the sets of conditions change since entry through "gate N" may result in exit at different points, i.e., through "gate T" or "gate R," dependent upon object state, of which only two possibilities are legal, "normal locked" and "reverse locked:"

If Object State is normal locked:

1. Opposing Gates

Entry through any gate is only safe when the other gates protecting an object are closed; in the case of this object "gate R" and "gate T" must be closed.

2. Object Occupancy

Entry through any gate is only safe when the object protected by the gate is unoccupied.

3. Adjoining Object Occupancy

Since entry through "gate N" with this Object State results in exit through "gate R," the object adjoining "gate R" must be unoccupied.

4. Adjoining Object Direction of Travel

Since entry through "gate N" with this Object State results in exit through "gate R," the object adjoining "gate R" must have a direction of travel associated with it that is not aligned against the direction of travel associated with the object protected by the "gate N."

If Object State is reverse locked:

1. Opposing Gates

Entry through any gate is only safe when the other gates protecting an object are closed; in the case of this object "gate R" and "gate T" must be closed.

2. Object Occupancy

Entry through any gate is only safe when the object protected by the gate is unoccupied.

3. Adjoining Object Occupancy

Since entry through "gate N" with this Object State results in exit through "gate T," the object adjoining "gate T" must be unoccupied. In addition, the object adjoining "gate R" must be unoccupied to avoid the possibility of sideswiping another vehicle.

4. Adjoining Object Direction of Travel

Since entry through "gate N" with the Object State results in exit through "gate T," the object adjoining "gate T" must have a direction of travel associated with it that is not aligned against the direction of travel associated with the object protected by the "gate N."

By examining all of the possible objects that can form an interlocking zone, e.g., simple switches, turntables, scissors crossovers, etc., and defining rule-sets based on differing Virtual Gate types which can be made to apply to these objects, in the manner done with the simple switch object in the example above, a "smart" interlocking system can be devised that can be implemented by a computer which can handle even the most complex interlocking zones. However, as opposed to its boolean equation solving relative, this system only requires a high-level description of a guideway layout to be able to perform the interlocking functions for the system, as the interlocking "intelligence" is intrinsic to the computer.

Furthermore, the rules for each object may be expanded to include particular application requirements, if additional restrictions are desirable.

Virtual Gates can also be dynamically assigned to areas to afford protection while portions of a guideway are being serviced, extensions added, etc., or where for some reason a protected zone needs to be established, or a refined control over train motion is to be enforced.

Through the Rules-Based Interlocking Engine, a safe, interlocked region can then be defined by a synthesis of these "atomic" objects, of which each object's rule set provides for the safety of the object itself, while taking into account the states of any adjacent objects which could also impact its safety. Since the protection of each "atomic" object is paramount to the system, the protection of the entire interlocked region as a whole is guaranteed.

Therefore, regardless of the complexity of a guideway layout, the capability of the Rules-Based Interlocking Engine to safely grant interlocking requests is unaffected. In addition, safety certification is less costly and easier to achieve, since only the ability of each respective set of rules to fully protect its associated object must be validated, not a complete set of the individual equations that define a complex interlocking relationship.

Also, once the Rules-Based Interlocking Engine has been safety certified, it would not have to be re-certified if changes are made to an existing guideway model, or if the system itself is applied to an entirely new guideway, since no changes to the executable code are necessary. Only a review of the Guideway Definition File for completeness would be required.

Since a Guideway Definition File is plain text ASCII, and all of the interlocking logic is contained in the rule sets, an individual without interlocking design experience can create, modify, and maintain the system as required.

Furthermore, by utilizing the functionality provided by the Rules and Initialization sections of the Guideway Definition File, this unique implementation of a solid-state interlocking system can be easily adapted to mimic the actual time response of its vital relay based predecessor. This enhanced flexibility avoids many of the pitfalls encountered in prior attempts at migration to solid-state interlocking systems.

It may be useful at this point to consider the "environment" in which an embodiment of the system according to the present invention operates. The environment for the Rules-Based Interlocking Engine (RBIE) is defined by the contents of three Definition Files: the Application Definition File (also referred to herein as the Guideway Definition File), the System Hardware Definition File, and the Software Definition File. Each of these files is parsed by the RBIE to produce a model for the RBIE environment. This approach allows the RBIE to execute on any target hardware and support any safety application.

The application hardware environment: a description of the safety applications' environment is placed in an Application Definition File in plain ASCII text (i.e., the Guideway Definition File of the Appendix, described above). This file is divided into several sections, each of which has a specific purpose. The Definition Section is used to describe all of the objects in the environment which in some manner impact the safety of the system. The Relation Section is used to build associations between these objects (such as a track circuit is associated with a particular gate in a train control application, or a specific flight path might be associated with a particular runway in an air traffic control application). A Rules Section is also included, which is used to exceptional or application-specific rules used in making safety-critical decisions. Finally, an Initialization Section is used to set the initial values and states of objects in the system, if necessary. This information is parsed by the system, with the information provided being used to construct an internal Safety Application Data Model consisting of all the applications' objects and their interrelationships.

The system hardware environment: the system hardware environment is also defined by an ASCII text definition file, the System Hardware Definition File. This file is organized in much the same way as the Application Definition File. The Definition Section defines all of the objects that must be operated by the system (such as the CPU, math co-processor, timers, I/O devices, etc.), and defines all information necessary for their operation, such as port numbers, interrupt vector, I/O type, necessary filter times and run-time reliability tests. The system parses this information to produce a data model representing the target hardware environment. An example of a System Hardware Definition file is presented on Appendix pages A12 and A13.

The software environment: the software environment is also defined by an ASCII text definition file. This file defines the tasks being performed by the system, their location in RAM, maximum run times, task priorities, and other necessary information about each task. It will also associate each interrupt handler with an interrupt vector.

Figure 3:
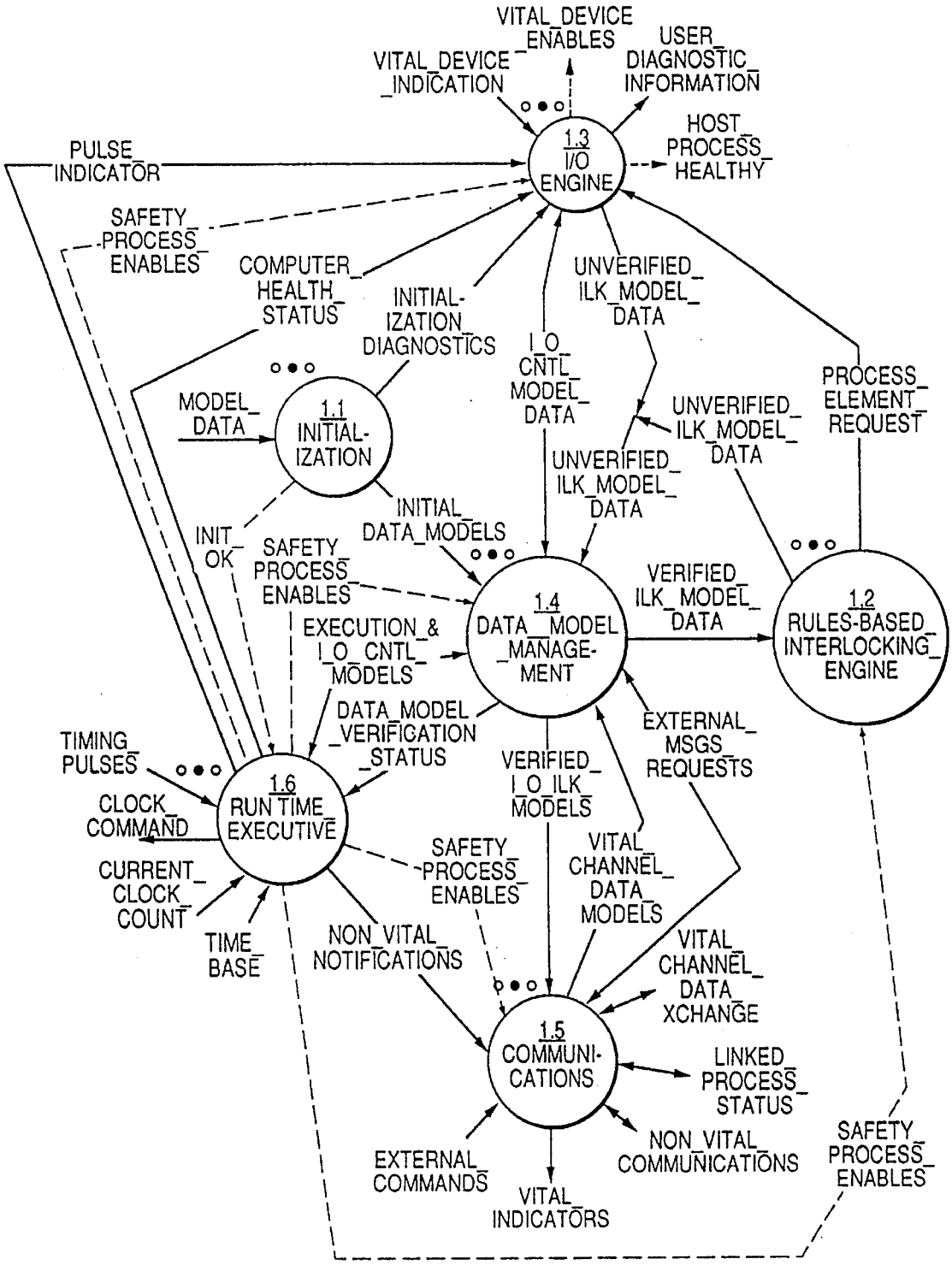
FIGS. 3, 3.1*a*, 3.1*b*,3.2*a*–3.2*c*, 3.3*a*, 3.3*b*, 3.4, 3.5 and 3.6*a*–3.6*c*, are flow diagrams of an implementation according to an embodiment of the invention.

The basic software elements that form an RBIE application according to an embodiment of the invention are named Initialization, Rules-Based Interlocking Engine, I/O Engine, Data Model Management, Communications, and Run-Time Executive. The relationship of these elements is shown in the data flow diagram of FIG. 3, and data flow diagrams for each element are provided in subsequent FIGS. 3.1*a–b*, 3.2*a–c*, 3.3*a–b*, 3.4, 3.5 and 3.6*a–c*. Only those details required for an understanding of the invention will be described in the interests of economy.

Initialization 1.1 (FIGS. 3 and 3.1*a–b*): Initialization is responsible for placing the application in a known safe state. The environment data models are created from their associated definition files. Then tests are performed on the system hardware, according to the data located in the System Hardware Data Model. The system will continue to run-time operation only if initialization results in a safe starting state.

Rules-Based Interlocking Engine 1.2 (FIGS. 3 and 3.2*a–c*): The Rules-Based Interlocking Engine element accepts control requests. These requests are then processed according to the existing rules base and any additional rules derived in the Application Data Model. If the request results in a safe operation, then the request is queued for action, otherwise it would be rejected. The Rules-Based Interlocking Engine also monitors system states to ensure that any changes would not result in accepted requests leading to unsafe conditions.

I/O Engine 1.3 (FIG. 3 and 3.3*a–b*): The I/O Engine element processes an I/O to/from the System Hardware. The I/O Engine provides an abstraction layer from the hardware and handles such items as filtering and debouncing. Therefore, the rest of the system only has to deal with the data at the high level.

Data Model Management 1.4 (FIGS. 3 and 3.4): Data Model Management updates, verifies and controls access to all system data models. The main purpose behind this element is to hide unnecessary data details from the application. It is also responsible for validating data models at critical periods in the system operations (such as after the data is input and prior to data output). Under all circumstances, this validation checks the accuracy of the data, but when a multi-processor architecture is used, the data from one channel is checked against the corresponding data in other channels. If the data does not match, then the fault is analyzed for severity by the Run-Time Executive and appropriate actions taken.

Communications 1.5 (FIG. 3 and 3.5): This element is responsible for the handling of communications between the safety computer and all other computes in its environment. This could include:

communications with non-safety related operations computers, redundant safety-related computers, and other networked safety-related computers.

Data received from any other computer is validated by the Data Model Management before its use, and output data is validated before being output by the Communications.

Run-Time Executive 1.6 (FIGS. 3 and 3.6*a–c*): The Run-Time Executive element is responsible for the reliable execution of all tasks in the system, and ensuring that no system fault would result in an unsafe condition. In order to do this, it monitors the execution time of each task, and the execution status of each system hardware element. If an error occurs, it is analyzed for severity. It is determined that the fault would lead to an unsafe condition, then the system stops all operations at a known safe state until safe operations could be continued.

The above description and examples have been concerned primarily with controlling entry to objects in an interlocking system. However, other aspects of safety control may be advantageously handled by the invention, for example, one or more of a series of track sections may have a maximum speed and the system can ensure that this speed is not exceeded by considering speed and building it into the rules. For example, entry to a track section might be denied or permitted depending on the speed of the train. Since the state of adjoining track sections are part of the decision, it may be that if a train is a slow moving freight train, entry into a particular track section can be safely permitted, whereas if the train were a high-speed commuter train, entry cannot be safely permitted.

Another important component of the Rules-Based Interlocking Engine (RBIE) is the Speed Code Selection Engine (hereafter referred to s SCSE), which controls the actual motion of the vehicles on the guideway. Using the same object-oriented data model that is used by the RBIE for decision making, the SCSE determines the maximum speed allowed for each vehicle on the guideway. Basically, the SCSE performs its function as follows.

Using the system data model, the states of all objects related to a track circuit are checked against the rules for safe vehicle motion. Next, the direction of travel for the track circuit is used to "look ahead" to following track circuits, which are evaluated to determine if movement into them is safe (i.e., unoccupied, switch locked in positions, etc.). The evaluation stops when the maximum "look ahead" distance has been traversed, or a track circuit is encountered into which movement is not permitted. This count of traversable track circuits is then used as an index into the speed code table for the track circuit for the current direction of travel. Lastly, the resulting speed value is compared to any speed restrictions that may have been placed on the track circuit, and the more restrictive of the two values is used as the current speed code. After the entire guideway has been evaluated in this fashion, the new speed codes are transmitted out to the track circuits, where they are responded to by the vehicle.

The system may perform the actual calculation of the speed value, rather than merely the selection, by adding the appropriate data to that system data model for each track circuit (weather conditions, grade, curve, track circuit length, etc.).

It will be apparent to one of ordinary skill in the art that the manner of making and using the claimed invention has been adequately disclosed in the above written description of the preferred embodiment taken together with the drawings.

It will be understood that the above description of the preferred embodiment of the present invention is susceptible to various modifications, changes, and adaptations, and the same are intended to be comprehended within the meaning and range of equivalents of the appended claims.

For example, hierarchical gate classes could be used wherein gates would not necessarily have to be defined by strict types, but could instead be defined in a hierarchy. The base gate type would have a minimal set of rules. These rules would then be built on by more detailed gate types. The more detailed gates would inherit the attributes of the parent type and the attributes of the parent could be replaced by specific rules for that class of gates. Any gate types which would have that gate type as a parent would inherit all the rules pertaining to that gate type (including the rules and attributes that it had inherited and not replaced).

For example, the base gate class would contain the following rules:

The gate being requested would not be granted unless all track blocks related to it, except for the entry point, where unoccupied.

The gate could not be granted unless all gates related to it were in a closed state.

The gate could only be granted if the object being requested were in a safe position.

The gate could only be granted if direction of travel allowed entry into and out of the gate in the same direction.

Then, more specific rules could be defined for specific types of gates, for example, a tangent gate:

The rule concerning occupancies would be inherited from the parent gate and would not need to be redefined.

The rule concerning gate states would also be inherited.

The rule concerning object position would also be inherited.

The rule concerning direction of travel would be extended to include the direction of travel on a connected guideway.

These rules could then be defined further, if necessary.

Alternately, Protection Zones could be used. In this concept, an object would be protected by a Protection Zone. This zone would be related in the data model to the objects being protected and those which would affect the protection. A simple switch would be protected by a single Protection Zone.

Figure 10:
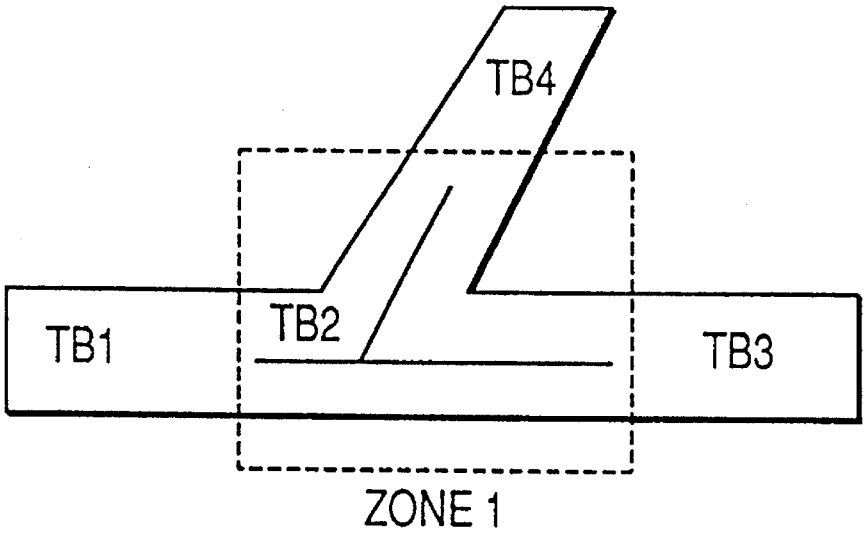
FIG. 10 shows a simple switch protected by a Protection Zone.

For example, FIG. 10 illustrates a simple switch protected by a Protection Zone. The Definition File would define the zone and relate it to the switch and the four track blocks illustrated (TB1, TB2, TB3 and TB4). The rules pertaining to the Protection Zone would then be:

The zone being requested would not be granted unless all track blocks related to it, except for the entry point, were unoccupied.

The zone could only be granted if it were currently unopened.

The zone could only be granted if the object being requested were in a safe position.

The zone could only be granted if direction of travel allowed travel through the zone (i.e., the current direction of travel at any two gates could not both lead into the Protection Zone).

Figure 11:
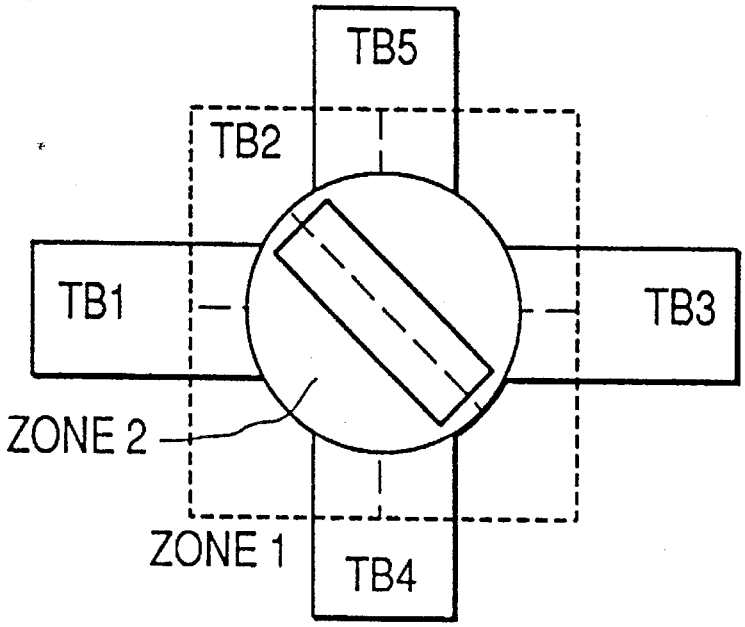
FIG. 11 shows a Roundtable protected by Protection Zones.

FIG. 11 illustrates the usage of a Protection Zone as it would apply to a Roundtable. If a vehicle were to request access from TB1, using the rules defined above, all track blocks related to the Roundtable (TB2, TB3, TB4 and TB5) would have to be unoccupied, no other vehicle would have gained access to the zone, the Roundtable would have to be locked in a position connecting TB1 with TB3, and the direction of travel would point from TB1 to TB3.

And in another implementation, Dynamic Zones could be used. With the advent of new technologies and concepts, new capabilities will be required. Currently, automated train control is based on the concept of a fixed block, which contains the concept of a track block. This simplifies the rules concerning interlocking. However, a moving block concept is not based on track blocks and other ways must be found to protect these systems.

A possibility would be the Dynamic Zone, which would contain dynamic elements to cover the contingencies provided by the new technology. It would be able to expand and contract its coverage zone depending on the current state of the guideway. An automated system would also have the capability to add or subtract a zone from a system as the need arises.

The Dynamic Zone can also work in the same fashion as the Protection Zone, and would, for static objects. The main difference would occur during emergencies, where the control system would be able to create temporary Protection Zones, relating them to objects which required protection. It would also be able to dynamically size the zones for static objects based on current conditions (such as current vehicle speed, weather conditions, etc.), the greater the need for protection, the larger the size of the zone.

What is claimed is:

1. A method of implementing a computer based interlocking system for protecting trains traversing a guideway system, said guideway system comprising guideways comprised of guideway objects which influence movement of trains in the guideway system, comprising:

providing a data base of prestored rule sets for a plurality of guideway objects, said guideway objects defined by entry and exit points, the entry point to at least one guideway object being a virtual gate, the rule sets defining conditions for a respective guideway object which must be met before entry through a virtual gate of said object is permitted;

inputting a high-level description of a guideway system layout including all of the guideway objects that make up guideways in the guideway system;

processing by a computer implemented interlocking engine the high-level description of the guideway system layout using the prestored rule sets to form an internal guideway data model;

supplying status signals from guideway objects and control requests to said interlocking engine;

processing said status signals and control requests by said interlocking engine in real time with reference to said prestored rule sets and said internal guideway data model; and outputting control signals denying control requests that would result in unsafe conditions.

2. The method according to claim 1, wherein the high-level description of a guideway system layout comprises:

a definition section which describes the entire makeup of the guideway system layout, including the guideways and corresponding guideway objects;

a relation section which defines associations between guideway objects and guideways in the guideway system;

a rules section which states the rules which govern application specific modifications to standard interlocking situations for the guideway objects that make up the guideway system in relation to the current state of those objects; and an initialization section which permits setting of values for the guideway objects for use during operation of the computer based interlocking system.

3. The method according to claim 1, wherein the step of inputting the high-level description of a guideway system layout comprises:

inputting a definition section which describes the entire makeup of the guideway system layout, including the guideways and corresponding guideway objects;

inputting a relation section which defines associations between the guideway objects and guideways in the guideway system;

inputting a rules section which states the rules which govern application specific modifications to standard interlocking situations for the guideway objects that make up the guideway system in relation to the current state of those objects; and inputting an initialization section which permits setting of values for the guideway objects for use during operation of the computer based interlocking system.

4. The method according to claim 1, wherein the step of processing to form an internal guideway data model comprises:

parsing the high-level description of a guideway system layout; and locating, retrieving and linking appropriate rule sets and corresponding respective guideway objects thereby forming an internal guideway data model which includes all of the guideway system objects and their interrelationships.

5. The method according to claim 1, wherein the rule sets are based on the Association of American Railways recommended design practices for design of vital relay based interlocking logic circuits.

6. In a digital computer, a rules based interlocking system for automatic train protection of a guideway comprising:

a guideway data model comprising a plurality of data entries specifying guideway objects, at least one of the guideway objects corresponding to guideway hardware devices, the guideway data model specifying relationships between the guideway objects;

a data base comprising rule sets for a plurality of guideway objects, said guideway objects defined by entry and exit points, the entry point to at least one guideway object being a virtual gate, the rule sets defining conditions for a respective guideway object which must be met before entry of a train through a virtual gate of said object is permitted;

a user input guideway definition file comprising a high-level description of the guideway, including the guideway objects;

a data model parser for parsing the guideway definition file and producing the guideway data model using the data base comprising the rule sets;

an interlocking engine for processing status signals in real time to produce control signals; and I/O control means for sending said control signals to the guideway hardware devices and for receiving said status signals from the guideway hardware devices based on the guideway data model and sensed status signals.

7. A method of implementing a computer based interlocking system for automatic train protection, comprising:

providing a data base of prestored rule sets for a plurality of guideway objects, the guideway objects being represented as at least one virtual gate of a plurality of virtual gate types, the rule sets defining conditions for a respective guideway object which must be met before entry through a virtual gate of said object is permitted;

inputting a high-level description of a guideway layout including all of the guideway objects that form interlocking zones; and processing the high-level description using the pre-stored rule sets to form an overall interlocking system definition by locating, retrieving and linking appropriate rule sets corresponding to the respective input guideway objects.

8. The method according to claim 7, wherein the objects include simple switches, turntables and scissors crossovers.

9. The method according to claim 7, wherein three types of virtual gates are used to represent a simple switch object, the three types of virtual gates corresponding to a respective direction of approach to the switch, the direction of approach being one of normal, reverse and tangent.

10. The method according to claim 9, wherein a rule set for a simple switch object includes a plurality of conditions for each virtual gate type which must be met for entry through the virtual gate, the conditions comprising:

an object state condition defining a switch position in which entry through the virtual gate is allowed;

at least one opposing gates state condition defining at least one states that the other virtual gate of the switch must be in for entry through the virtual gate to be allowed;

at least one object occupancy state condition defining at least one occupancy state of the switch in which entry through the virtual gate is allowed;

at least one adjoining object occupancy state condition defining at least one occupancy state any adjoining objects must be in for entry through the virtual gate to be allowed; and at least one adjoining object direction of travel state condition defining at least one travel direction state any adjoining objects must be in for entry through the virtual gate to be allowed.

11. The method according to claim 7, wherein the rule sets are based on the Association of American Railways recommended design practices for design of vital relay based interlocking logic circuits.

12. In a digital computer, a rules based interlocking system for automatic train protection of a guideway comprising:

a guideway data model comprising a plurality of data entries specifying guideway objects, at least one of the guideway objects corresponding to guideway hardware devices, the guideway objects being represented as at least one virtual gate of a plurality of virtual gate types, the guideway data model specifying relationships between the guideway objects;

a database comprising rule sets for a plurality of guideway objects, the rule sets defining conditions for a respective guideway object which must be met before entry of a train through a virtual gate of said object is permitted;

a user input guideway definition file comprising a high-level description of the guideway, including the guideway objects;

a data model parser for parsing the guideway definition file and producing the guideway data model using the database comprising the rule sets; and I/O control means for sending control signals to the guideway hardware devices and for receiving status signals from the guideway hardware devices based on the guideway data model and sensed status signals.

13. A method of forming a database representing a guideway in a computer based interlocking system, comprising:

dividing a guideway into a plurality of guideway objects;

for each of the plurality of guideway objects, representing each entry point into the guideway object as a virtual gate of a plurality of virtual gate types;

storing a rule set for each virtual gate type, the rule sets specifying virtual gate entry condition requirements; and associating the rule sets with the respective virtual gates of the plurality of guideway objects.

14. A method of representing a simple switch as a guideway object in a computer based guideway control system, wherein the simple switch is divided into a plurality of virtual gates, comprising for each virtual gate type:

storing an object state condition defining a switch position in which entry through the virtual gate is allowed;

storing at least one opposing gates state condition defining at least one state that other virtual gates of the switch must be in for entry through the virtual gate to be allowed;

storing at least one object occupancy state condition defining at least one occupancy state of the switch in which entry through the virtual gate is allowed;

storing at least one adjoining object occupancy state condition defining at least one occupancy state any adjoining objects must be in for entry through the virtual gate to be allowed; and storing at least one adjoining object direction of travel state condition defining at least one travel direction state any adjoining objects must be in for entry through the virtual gate to be allowed.

15. A computer implemented interlocking system protecting trains traversing a guideway system, said guideway system comprised of guideway objects which influence movement of trains in the system comprising:

a computer;

a guideway data model stored in said computer comprising a plurality of data entries specifying said guideway objects, said guideway objects defined by entry and exit points, the entry point to at least one guideway object being a virtual gate, at least one of the guideway objects corresponding to guideway hardware devices, the guideway data model specifying relationships between the guideway objects;

a data base stored in said computer comprising rule sets for a plurality of guideway objects, the rule sets defining conditions for a respective guideway object which must be met before entry of a train through a virtual gate of said object is permitted;

a computer implemented interlocking engine for processing status signals with reference to said data model and said rule sets in real time to produce control signals with reference to said data model and said rule sets; and input/output (I/O) control means for sending said control signals to the guideway hardware devices and for receiving said status signals from the guideway hardware devices.

16. A computer implemented interlocking system protecting trains traversing a guideway system, said guideway system comprised of guideway objects which influence movement of trains in the system comprising:

a computer;

a guideway data model stored in said computer comprising a plurality of data entries specifying said guideway objects, said guideway objects defined by entry and exit points, the entry point to at least one guideway object being a virtual gate, at least one of the guideway objects corresponding to guideway hardware devices, the guideway data model specifying relationships between the guideway objects;

a data base stored in said computer comprising rule sets for a plurality of guideway objects, the rule sets defining conditions for a respective guideway object which must be met before entry of a train through a virtual gate of said object is permitted;

a computer implemented interlocking engine for processing status signals with reference to said data model and said rule sets in real time to produce control signals with reference to said data model and said rule sets;

a computer implemented speed code selection engine for processing said status signals in real time with reference to the data model and rule sets to produce speed control signals;

input/output (I/O) control means for sending said control signals to the guideway hardware devices and said speed control signals to trains and for receiving said status signals from the guideway hardware devices.

17. A computer implemented interlocking system protecting trains traversing a guideway system, said guideway system comprised of guideway objects which influence movement of trains in the system comprising:

a computer;

a guideway data model stored in said computer comprising a plurality of data entries specifying said guideway objects, said guideway objects defined by entry and exit points, the entry point to at least one guideway object being a virtual gate, at least one of the guideway objects corresponding to guideway hardware devices, the guideway data model specifying relationships between the guideway objects;

a data base stored in said computer comprising rule sets for defining protection zones for gateway objects, there being rules for a plurality of gateway objects, the rule sets defining conditions for a respective gateway object which must be met before entry of a train is permitted into a protection zone for said object;

a computer implemented interlocking engine for processing status signals with reference to said data model and said rule sets in real time to produce control signals with reference to said data model and said rule sets; and input/output (I/O) control means for sending said control signals to the guideway hardware devices and for receiving said status signals from the guideway hardware devices.

18. The interlocking system according to claim 17 wherein the rule set data base comprises rules for dynamically expanding and contracting the extent of protection zones along the guideway depending upon current state of the guideway.

19. The interlocking system according to claim 17 wherein the rule set data base comprises rules for dynamically adding and subtracting protection zones depending on current state of the guideway.

* * * * *

UNITED STATES PATENT AND TRADEMARK OFFICE

CERTIFICATE OF CORRECTION

PATENT NO. : 5,463,552

DATED : October 31, 1995

INVENTOR(S) : Richard A. Wilson, Jr., John M. Daubner and Frank D. Jeffers

It is certified that error appears in the above-indentified patent and that said Letters Patent is hereby corrected as shown below:

Column 5 Line 32 "FIG.," should read --FIG.--.

Column 6 Line 26 after "A4" insert --.--.

Column 6 Line 39 " "TRACK-_CIRCUIT" " should read --"TRACK_CIRCUIT"--.

Column 6 Line 54 " "ST1$_{13}$ DEP" " should read --"ST1_DEP"--.

Column 6 Line 56 " "TERM$_{13}$DEP" " should read --"TERM_DEP"--.

Column 6 Line 59 " "GATE$_{13}$N" "A$_{13}$B006" " should read --"GATE_N" "A_B006"--.

Column 7 Line 11 " "ST1_ARV$_{13}$1" " should read --"ST1_ARV_1"--.

Column 7 Line 27 "an keyword" should read --a keyboard--.

Column 7 Line 61 after "any" insert --of--.

Column 8 Line 30 " "GATE$_{13}$N C_A0007 " should read --"GATE_N C_A007--.

Column 13 Line 13 "computes" should read --computers--.

Column 13 Line 28 "It" should read --If--.

UNITED STATES PATENT AND TRADEMARK OFFICE

CERTIFICATE OF CORRECTION

PATENT NO. : 5,463,552
DATED : October 31, 1995
INVENTOR(S) : Richard A. Wilson, Jr., John M. Daubner and Frank D. Jeffers It is certified that error appears in the above-indentified patent and that said Letters Patent is hereby corrected as shown below:

Column 13 Line 48 "to s" should read --to as--.

Claim 10 Line 44 Column 17 "states" should read --state--.

Claim 10 Line 44 Column 17 "gate" should read --gates--.

Signed and Sealed this

Fourteenth Day of May, 1996

*Attest:*

Bruce Lehman

BRUCE LEHMAN

*Attesting Officer*

*Commissioner of Patents and Trademarks*